US005460924A

United States Patent [19]

Buchanan et al.

[11] Patent Number: 5,460,924

[45] Date of Patent: Oct. 24, 1995

[54] PHOTOGRAPHIC PERACID BLEACHES WITH FERRIC 2-PYRIDINECARBOXYLATE AND 2,6-PYRIDINECARBOXYLATE CATALYSTS

[75] Inventors: John M. Buchanan, Rochester; Stuart T. Gordon, Pittsford; Keith H. Stephen, Rochester; Richard P. Szajewski, Rochester; Sidney J. Bertucci, Rochester, all of N.Y.

[73] Assignee: Eastman Kodak Company, Rochester, N.Y.

[21] Appl. No.: 230,189

[22] Filed: Apr. 20, 1994

Related U.S. Application Data

[63] Continuation-in-part of Ser. No. 101,136, Aug. 2, 1993, abandoned, which is a continuation-in-part of Ser. No. 990,500, Dec. 14, 1992, abandoned.

[51] Int. Cl.[6] ..... G03C 7/02; G03C 7/384; G03C 7/42

[52] U.S. Cl. ..... 430/393; 430/430; 430/461; 430/943; 430/421; 430/427; 430/386; 430/387; 252/186.1; 252/186.21; 252/186.38; 252/186.39

[58] Field of Search ..... 430/393, 430, 430/461, 943, 421, 427; 252/186.1, 186.21, 186.38, 186.39

[56] References Cited

U.S. PATENT DOCUMENTS

| | | | |
|---|---|---|---|
| 2,600,788 | 6/1952 | Loria et al. | 430/386 |
| 3,519,429 | 7/1970 | Lestina | 430/554 |
| 3,707,374 | 12/1972 | Van Der Voorn et al. | 430/430 |
| 3,748,136 | 7/1973 | Willems | 430/430 |
| 3,772,020 | 11/1973 | Smith | 430/460 |
| 4,229,522 | 10/1980 | Nakamura et al. | 430/462 |
| 4,242,441 | 12/1980 | Nakamura et al. | 430/431 |
| 4,506,007 | 3/1985 | Nakajima et al. | 430/430 |
| 4,791,048 | 12/1988 | Hirai et al. | 430/470 |
| 4,880,725 | 11/1989 | Hirai et al. | 430/373 |
| 5,318,880 | 6/1994 | English et al. | 430/461 |

FOREIGN PATENT DOCUMENTS

| | | | |
|---|---|---|---|
| 329088 | 8/1989 | European Pat. Off. | 430/430 |
| 3919551 | 12/1990 | Germany | 430/430 |
| 50-26542 | 3/1975 | Japan . | |
| 50-026542 | 3/1975 | Japan . | |
| 51-007930 | 1/1976 | Japan . | |
| 51-7930 | 1/1976 | Japan . | |
| 53-048527 | 5/1978 | Japan . | |
| 55-067747 | 5/1980 | Japan | 430/488 |
| 61-050140 | 3/1986 | Japan . | |
| 1-292339 | 11/1989 | Japan . | |
| 795914 | 6/1958 | United Kingdom . | |
| 2165954 | 4/1986 | United Kingdom | 430/421 |

OTHER PUBLICATIONS

Research Disclosure No. 15704, vol. 157, p. 8, (Price et al.) 1977.

*Primary Examiner*—Charles L. Bowers, Jr.
*Assistant Examiner*—J. Pasterczyk
*Attorney, Agent, or Firm*—J. Lanny Tucker; Sarah Meeks Roberts

[57] ABSTRACT

This invention provides an accelerator for peracid bleaches used for bleaching silver halide photographic elements. The accelerator is a complex of ferric (Fe III) ion and a 2-pyridinecarboxylic acid or a 2,6-pyridinecarboxylic acid. The accelerator may be contained in the bleaching solution, a solution preceding the bleaching solution or in the photographic elements themselves.

27 Claims, No Drawings

PHOTOGRAPHIC PERACID BLEACHES WITH FERRIC 2-PYRIDINECARBOXYLATE AND 2,6-PYRIDINECARBOXYLATE CATALYSTS

CROSS-REFERENCE TO RELATED APPLICATIONS

This Application is a continuation-in-part of co-pending U.S. application Ser. No. 08/101,136 filed Aug. 2, 1993, now abandoned, which is a continuation-in-part of application Ser. No. 07/990,500 filed Dec. 14, 1992, now abandoned.

FIELD OF THE INVENTION

This invention relates to the processing of color silver halide photographic elements. It more specifically relates to the use of bleach catalysts contained in processing solutions or the photographic elements themselves.

BACKGROUND OF THE INVENTION

The silver bleach solutions most commonly used for silver halide photographic elements use ferric complexes to oxidize silver metal to silver halide. It is environmentally desirable to reduce the concentrations and absolute amounts of iron and chelating agents discharged from processing machines, but simply reducing the iron and chelate concentrations results in unacceptable bleach performance. Persulfate bleaches are an alternative to iron-based bleaches, but they are slow acting unless used with bleach accelerators. Most of the commonly used accelerators are low molecular weight thiols which often have undesirable odors and are unstable if incorporated directly into the persulfate bleach.

German Patent Application DE 39 19 551 A1 describes certain persulfate bleaches incorporating a ferric salt, a chelating agent which may be an aminocarboxylic acid, a hydroxycarboxylic acid or a hydroxylpolycarboxylic acid, and a chloride rehalogenating agent. These formulations, however, slowly and incompletely bleach photographic elements with substantial contents of silver bromide and silver iodide. Another disadvantage of these bleaches is that they exhibit the best bleaching performance at low pH values (pH<3), where persulfate suffers acid catalyzed decomposition. This results in poor stability of the bleaches.

Japanese Kokai No. J5 0026-542 describes a bleaching solution containing an iron chelate and a 2-carboxypyridine. Japanese Kokai No. J5 1007-930 describes a process wherein either the bleach, the fix, or the wash can contain a pyridine-2,6-dicarboxylic acid. Japanese Kokai No. J5 3048-527 describes a bleach containing an aminopolycarboxylic acid metal complex salt and/or a pyridine-2,6-dicarboxylic acid salt. European Patent Application 0 329 088 describes a bleach containing, as one of numerous possible buffers, picolinic acid. None of the above references describe the use of a peracid bleach.

It is desirable to provide a peracid bleaching solution with low metal and ligand concentrations that rapidly and completely bleaches silver halide photographic elements containing a wide variety of silver halide compositions. It is further desirable to provide a ferric-catalyzed persulfate bleach exhibiting excellent silver bleaching at pH values greater than 3, where acid-catalyzed decomposition of persulfate is negligible.

SUMMARY OF THE INVENTION

This invention provides a bleaching composition for color photographic elements, said bleach comprising a peracid or peracid salt and an accelerating amount of a complex of ferric ion and a 2-pyridinecarboxylic acid or a 2,6-pyridinedicarboxylic acid.

It further provides a method of processing a color photographic element comprising bleaching the photographic element in a peracid bleach solution in the presence of a complex of ferric ion and a 2-pyridinecarboxylic acid or a 2,6-pyridinedicarboxylic acid. In one embodiment, the complex of ferric ion and a 2-pyridinecarboxylic acid or a 2,6-pyridinedicarboxylic acid is contained in the bleach solution. In another embodiment, the complex of ferric ion and a 2-pyridinecarboxylic acid or a 2,6-pyridinedicarboxylic acid is in a solution preceding the bleaching solution. In a further embodiment, the complex of ferric ion and a 2-pyridinecarboxylic acid or a 2,6-pyridinedicarboxylic acid is contained in the photographic element being processed.

This invention also provides a photographic element comprising at least one light sensitive silver halide emulsion layer and a complex of ferric ion and a 2-pyridinecarboxylic acid or a 2,6-pyridinedicarboxylic acid.

Ferric complexes of substituted and unsubstituted 2-pyridinecarboxylic acid and 2,6-pyridinedicarboxylic acid are outstanding catalysts for peracid bleaching. They remove silver more rapidly and completely than other ferric-catalyzed bleaches described in the art. Rapid, essentially complete silver bleaching is achieved even with metal and ligand concentrations ten to twenty times lower than those of current iron-based bleaches. These bleaches are suitable for photographic elements with a variety of silver chloride, silver bromide, and silver iodide contents. In addition to being employed directly within the bleach, the ferric complexes can accelerate bleaching when coated directly in the film or introduced to the film from a processing solution that precedes the bleach.

Furthermore, they can be formulated without environmentally damaging ammonium ion and are sufficiently active to function with chloride as the rehalogenating agent, thus offering cost and health advantages over bromide-containing persulfate bleaches. Two of the preferred ligands, picolinic and dipicolinic acids, have been shown to be readily biodegradable and yet are remarkably stable toward oxidative decomposition in the presence of persulfate.

DETAILED DESCRIPTION OF THE INVENTION

Ferric complexes of substituted or unsubstituted 2-pyridinecarboxylic acid (I) and substituted or unsubstituted 2,6-pyridinedicarboxylic acid (II) may be used in small quantities to catalyze the silver bleaching activity of peracid bleaches. The substituents may be independently hydrogen, substituted or unsubstituted alkyl or aryl groups, chloro, nitro, sulfoamido, amino, carboxylic acid, sulfonic acid, phosphoric acid, hydroxy, or any other substituent that does not interfere with ferric complex formation, stability, solubility or catalytic activity. The substituents may also be the atoms necessary to form a ring between any of the positions. The substituents may be chosen for the express purpose of increasing the aqueous solubility of the ferric complex.

The preferred substituted or unsubstituted 2-pyridinecarboxylic acid and 2,6-pyridinedicarboxylic acids are of the following formula: t,0060 wherein $X_1$, $X_2$, $X_3$ and $X_4$ are independently H, OH, or $CO_2M$, $SO_3M$, or $PO_3M$, and M is H or an alkali metal cation. In the most preferred embodiment, $X_1$, $X_2$, $X_3$ and $X_4$ are H, e.g., the most preferred acids are unsubstituted 2-pyridinecarboxylic acid (picolinic acid) and unsubstituted 2,6-pyridinedicarboxylic acid.

The complexes may be prepared and isolated as their ammonium or alkali metal salts, or they can be synthesized in situ as part of the bleach preparation. The components and the complexes are commercially available, or they may be synthesized by methods known to those skilled in the art. For example, synthesis of t,0070
is described in L. Syper, K. Kloc, J. Mlochowski, *Tetrahedron,* 1980, vol. 36, pp. 123–129, and R. M. Engelbrecht, U.S. Pat. No. 3,766,258, Oct. 16, 1973, p. 8. Synthesis of t,0071
is described in J. S. Bradshaw et al., *J. Am. Chem. Soc.,* 1980, 102(2), pp. 467–74.

The ferric complexes may also be generated from the corresponding ferrous complexes or formed in situ from the ligand and a ferrous ion salt. The complexes and their components may be added by any method as known in the art, for example, dry pyridinedicarboxylic acid and a ferric salt may be added to a bleach solution or the ferric-bis-2, 6-pyridinedicarboxylate complex may be prepared and isolated as its sodium salt, which is then added to the bleach.

Typical peracid bleaches useful in this invention include the hydrogen, alkali and alkali earth salts of persulfate, peroxide, perborate, perphosphate, and percarbonate, oxygen, and the related perhalogen bleaches such as hydrogen, alkali and alkali earth salts of chlorate, bromate, iodate, perchlorate, perbromate and metaperiodate. Examples of formulations using these agents are described in *Research Disclosure*, December 1989, Item 308119, published by Kenneth Mason Publications, Ltd., Dudley Annex, 12a North Street, Emsworth, Hampshire P010 & DQ, England, the disclosures of which are incorporated herein by reference. This publication will be identified hereafter as *Research Disclosure.*

Additional hydrogen peroxide formulations are described in U.S. Pat. Nos. 4,277,556; 4,328,306; PCT/EP91/01377 (filed 24 Jul. 1991) of Marsden et al.; PCT/EP91/01973 (filed 17 Oct. 1991) of Fyson et al.; U.S. Pat. Nos. 4,454, 224; 4,717,649. Especially preferred are persulfate bleaches and peroxide bleaches, with sodium, potassium, or ammonium persulfate being particularly preferred. For reasons of economy and stability, sodium persulfate is most Commonly used. The preferred peroxide is hydrogen peroxide.

In a preferred embodiment, the ferric complexes are contained in the peracid bleach. These bleaches may contain ferric ion at a concentration of 0.001 to 0.100M and more preferably at a concentration of 0.001 to 0.025M; ligand at a concentration of 0.001 to 0.500M and more preferably at a concentration of 0.001 to 0.100M; persulfate ion at a concentration of 0.020 to 2.0M and more preferably at a concentration of 0.050 to 0.500M. Hydrogen peroxide, its salts or precursors may be partially or fully substituted for persulfate ion in these bleaches. The preferred concentration of peroxide is 0.1 to 2.0M, and more preferably 0.2 to 1.0M. Preferably, the bleaches also contain halide ion at a concentration of 0.025 to 2.0 M, with a preferred concentration of 0.050 to 0.500M. Chloride is the preferred halide ion because, while it still enables rapid bleaching,, it costs less than bromide, provides possible fixing advantages, and avoids health concerns associated with the oxidation of bromide to bromine. While faster silver bleaching may sometimes be obtained with constituent concentrations higher than those specified above as preferred, the lower concentrations may be preferred for environmental and economic reasons.

The preferred pH of the bleach composition is between 3 and 6. The pH may be maintained with any of a variety of organic or inorganic buffers, as long as the buffer has at least one $P_{Ka}$ value between 1.5 and 7.5 (preferably 3 to 6) and does not substantially disrupt the complexation of ferric ion by the pyridinecarboxylate ligand. Furthermore, the buffer should not be readily oxidized by the bleaching composition nor should it adversely affect image and masking dyes. It is to avoid such dye interactions that preferred buffers such as aliphatic or aromatic carboxylic acid buffers, and particularly sulfo-substituted aliphatic and aromatic carboxylic acid buffers are preferably used at concentrations and pH values such that the concentration of the basic form of the buffer (e.g., acetate ion) is less than 0.5M, and more preferably less than 0.2M. Examples of useful buffers are acetate, 2-methyllactate, phthalate, 4-sulfophthalate, 5-sulfoisophthalic acid, sulfoacetate, sulfosuccinate and trimellitate. In one embodiment, the ligand may also serve as the buffer. Preferably, a stop or stop-accelerator bath of pH$\leqq$7 precedes the bleaching step.

Examples of counterions which may be associated with the various salts in these bleaching solutions are sodium, potassium, ammonium, and tetraalkylammonium cations. It may be preferable to use alkali metal cations (especially sodium and potassium cations) in order to avoid the aquatic toxicity associated with ammonium ion. In some cases, sodium may be preferred over potassium to maximize the solubility of the persulfate salt. Additionally, the bleaching solution may contain anti-calcium agents, such as, e.g., 1-hydroxyethyl-1, 1-diphosphonic acid, that do not substantially interfere with ferric ion complexation by the ligand; chlorine scavengers such as those described in G. M. Einhaus and D. S. Miller, *Research Disclosure,* 1978, vol 175, p. 42, No. 17556; and corrosion inhibitors, such as nitrate ion, as needed. The bleaching compositions described here may be formulated as the working bleach solutions, solution concentrates, or dry powders. The bleach compositions of this invention can adequately bleach a wide variety of photographic elements in 30 to 240 seconds.

The ferric complexes may also be contained in a bleach pre-bath or other processing solution that precedes the bleach. This could include, for example, a wash bath, a stop bath, or the developer itself. Preferably, the complexes should be contained in a (dedicated) accelerator bath or a combination stop-accelerator bath. The concentration of the ferrous or ferric ion may be 0.001 to 0.100M, and the concentration of the 2-pyridinecarboxylic acid or 2,6-pyridinedicarboxylic acid may be 0.001 to 0.500M. Generally, the pH of the solutions preceding the bleach is less than 10 to prevent precipitation of the iron as rust. As for the persulfate solutions, ferric (ferrous) complexes may be added to the solutions preceding the bleach as solids: or solutions of the preformed complexes or solids or solutions of the iron salt and ligand.

In another embodiment, the ferric complexes may be incorporated into a photographic element. The ferric complexes may be incorporated into any layer of the photographic element. It is preferred that the complexes be incorporated into layers which do not contain imaging silver (a non-imaging layer) such as interlayers or the antihalation layer. Depending on the solubility of the complexes, they may be added as aqueous solutions, gelatin dispersions, or solid particle dispersions.

The amount of the ferric ion contained in the photographic element may be 5 to 250 micromoles per $ft^2$, and the amount of the 2-pyridinecarboxylic acid or 2,6-pyridinedicarboxylic acid may be 5 to 500 micromoles per $ft^2$, with 10 to 100 micromoles per $ft^2$ being preferred.

The present invention may be used in combination with other known means of accelerating persulfate bleaches. Examples of bleach accelerator releasing couplers are described in EP 0,193,389-B, EP 0,310,125, and U.S. Pat. No. 4,842,994 and the references therein. Thiol and metal complex persulfate accelerators are described in *Research Disclosure* No. 15704,. vol. 157, p. 8 (May, 1977). Persulfate bleach acceleration by ammonium, sulfonium, and pyridinium salts is described by Willems in U.S. Pat. No. 3,748,136. Aromatic amine accelerators are described by Van Der Voorn and Willis in U.S. Pat. No. 3,707,374. Silver thiolate salts as bleach accelerators are described by Harder and Singer in U.S. Pat. No. 4,865,956. Other useful accelerators are described in U.S. Pat. No. 3,772,020 (Smith).

The photographic elements useful with this invention can be single-color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single-segmented layer, e.g., as by the use of microvessels as described in Whitmore, U.S. Pat. No 4,362,806, issued Dec. 7, 1982. The element can contain additional layers such as filter layers, interlayers, overcoat layers, subbing layers, and the like. Due to the decreased D-min associated with persulfate bleaches, this invention may be particularly useful with those photographic elements containing a magnetic backing such as described in No. 34390, *Research Disclosure*, November, 1992.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of the invention can include various couplers including, but not limited to, those described in Research Disclosure Section VII, paragraphs D, E, F, and G, and the publications cited therein. These couplers can be incorporated in the elements and emulsions as described in Research Disclosure Section VII, paragraph C, and the publications cited therein.

Other useful couplers include couplers which form magenta dyes upon reaction with oxidized color developing agents, which are described in such representative patents and publications as U.S. Pat. Nos. 2,600,788; 2,369,489; 2,343,703; 2,311,082; 2,908,573; 3,152,896; 3,519,429; 3,062,653; and T. H. James, editor, *The Theory of the Photographic Process*, 4th Edition, MacMillan, New York, 1977, pp. 356–358; couplers which form yellow dyes upon reaction with oxidized color developing agents, which are described in such representative patents and publications as U.S. Pat. Nos. 2,298,443; 2,875,057; 2,407,210; 3,048,194; 3,365,506; 3,447,928; 5,021,333; and *The Theory of the Photographic Process*, pp. 354–356; and couplers which form cyan dyes upon reaction with oxidized color developing agents are described in such representative patents as U.S. Pat. Nos. 4,009,038; 4,666,826; 5,006,453; 5,026,631; and European Patent EP 271,005. Further useful couplers include the following: t,0130

Two-equivalent couplers are useful with this invention, particularly coupler C-38.Magenta coupler C-38 can be prepared as described in U.S. Pat. No. 4,853,319 (Krishnamurthy) dated Aug. 1, 1989, hereby incorporated by reference, and *Research Disclosure*, Item 16736,March 1978, published by Kenneth Mason Publications, Ltd., Didley Annex, 12a North Street, Emsworth, Hampshire P010 & DQ, England.

The photographic elements of this invention or individual layers thereof can contain, among other things, brighteners (examples in Research Disclosure Section V), antifoggants and stabilizers (examples in Research Disclosure Section VI), antistain agents and image dye stabilizers (examples in Research Disclosure Section VII, paragraphs I and J), light absorbing and scattering materials (examples in Research Disclosure Section VIII), hardeners (examples in Research Disclosure Section X), plasticizers and lubricants (examples in Research Disclosure Section XII), antistatic agents (examples in Research Disclosure Section XIII), matting agents (examples in Research Disclosure Section XVI), and development modifiers (examples in Research Disclosure Section XXI).

The photographic elements can be coated on a variety of supports including, but not limited to, those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image, examples of which are described in Research Disclosure Section XIX. Processing to form a visible dye image includes the step of contacting the element with a color-developing agent to reduce developable silver halide and oxidize the color-developing agent. Oxidized color-developing agent, in turn, reacts with the coupler to yield a dye.

The color-developing solutions typically contain a primary aromatic amino color-developing agent. These color-developing agents are well known and widely used in variety of color photographic processes. They include aminophenols and p-phenylenediamines.

In addition to the primary aromatic amino color-developing agent, color-developing solutions typically contain a variety of other agents, such as alkalies to control pH, bromides, iodides, benzyl alcohol, antioxidants, antifoggants, solubilizing agents, brightening agents, and so forth.

Photographic color-developing compositions are employed in the form of aqueous alkaline-working solutions, having a pH of above 7, and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent for color-developing compositions.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching and fixing to remove silver and silver halide, washing, and drying.

Fixing agents include compounds which react with silver halide to form a water-soluble complex salt, e.g., thiosulfates such as potassium thiosulfate, sodium thiosulfate and ammonium thiosulfate; thiocyanates such as potassium thiocyanate, sodium thiocyanate and ammonium thiocyanate; thioureas; thioethers, and halides such as iodides.

The fixer may contain one or more pH buffers comprising various acids and salts such as boric acid, borax, sodium hydroxide, potassium hydroxide, sodium carbonate, potassium carbonate, sodium bicarbonate, potassium bicarbonate, acetic acid, sodium acetate and ammonium hydroxide, as well as fixing agent. Also, it is possible to add, as appropriate, substances known to be usually added to the fixer, such as pH buffers, e.g., borates, oxalates, acetates, carbonates, phosphates; alkylamines and polyethyleneoxides.

The above fixing agents are normally used at over 0.1 mol per 1 processing solution; from the viewpoint of the desired effect of the invention, it is preferable to use these agents in the range of from 0.6 to 4 mols, more preferably 0.9 to 3.0 mols, still more preferably 1.1 to 2.0 mols.

Typically, a separate pH lowering solution, referred to as a stop bath, is employed to terminate development prior to bleaching. A stabilizer bath is commonly employed for final washing and hardening of the bleached and fixed photographic element prior to drying. Conventional techniques for processing are illustrated by Research Disclosure, Paragraph XIX.

Preferred processing sequences for color photographic elements, particularly color negative films and color print papers, include the following:

(P-1) Color Development/Stop/Bleaching/Fixing/Washing/Stabilizing/Drying.

(P-2) Color Development/Stop/Bleaching/Fixing/Stabilizing/Drying.

(P-3) Color Development/Bleaching/Fixing/Washing/Stabilizing/Drying.

(P-4) Color Development/Bleaching/Fixing/Washing.

(P-5) Color Development/Bleaching/Fixing/Stabilizing/Drying.

(P-6) Color Development/Stop/Washing/Bleaching/Fixing/Washing/Drying.

In each of processes (P-1) to (P-6), variations are contemplated. For example, a bath can be employed prior to color development, such as a prehardening bath, or the washing step may follow the stabilizing step. Additionally, reversal processes which have the additional steps of black and white development, chemical fogging bath, light reexposure, and washing before the color development are contemplated.

The following examples are intended to illustrate, without limiting, this invention.

EXAMPLE 1

Preparation of Bleaches and Bleach Pre-Baths Preparation Of Persulfate Bleach A (Invention).

To one liter of distilled water was added, with stirring, 2,6-pyridinedicarboxylic acid (9.19 g), ferric nitrate nonahydrate ($Fe(NO_3)_3.9H_2O$, 10.10 g), and glacial acetic acid (115 ml). Concentrated ammonium hydroxide (20 ml) was added dropwise, followed by sodium persulfate ($Na_2S_2O_8$, 59.525 g), and sodium chloride (NaCl, 17.53 g). Water was added to make 1.9 liters, and additional ammonium hydroxide (56 ml) was added to adjust the pH to a value of 4.0 at 40° C. Finally, water was added to adjust the final volume to 2.0 liters.

Preparation Of Persulfate Bleach B (Comparison).

To one liter of distilled water was added, with stirring, tetrasodium ethylenediaminetetraacetic acid (10.45 g), ferric nitrate nonahydrate ($Fe(NO_3)_3.9H_2O$, 10.10 g), and glacial acetic acid (115 ml), sodium persulfate ($Na_2S_2O_8$, 59.525 g), and sodium chloride (NaCl, 17.53 g). Concentrated ammonium hydroxide (63 ml) was added dropwise to adjust the pH to a value of 4.0 at 40° C., and water was added to bring the final volume to 2.0 liters.

Preparation Of Persulfate Bleach C (Comparison, DE 3,919,550).

To 1.7 liters of distilled water was added, with stirring, potassium persulfate ($K_2S_2O_8$, 40.0 g), citric acid (40.0 g), sodium chloride (NaCl, 40.0 g), and ferric nitrate nonahydrate ($Fe(NO_3)_3.9H_2O$, 32.0 g). A pH value of 1.07 was measured at 40° C., and water was added to adjust the final volume to 2.0 liters.

Preparation Of Bleach D (Invention).

To an eight liter stainless steel tank were added six liters of distilled water, 2,6-pyridinedicarboxylic acid (36.77 g), glacial acetic acid (45.8 ml), and, slowly, sufficient 4.0M aqueous sodium hydroxide (94.5 ml) to adjust the solution pH to 4.0. Ferric nitrate nonahydrate ($Fe(NO_3)_3.9H_2O$, 40.41 g), sodium persulfate (476.21 g), and sodium chloride (70.13 g) were added with stirring before the final pH was adjusted to 4.0 with 55 ml 4.0M sodium hydroxide.

Preparation Of Bleach E (Invention).

To an eight liter stainless steel tank were added six liters of distilled water, 2-pyridinecarboxylic acid ("picolinic acid", 40.63 g,), glacial acetic acid (45.8 ml), and, slowly, 4.0M aqueous sodium hydroxide (36.4 ml) sufficient to adjust the solution pH to 4.0. Ferric nitrate nonahydrate ($Fe(NO_3)_3.9H_2O$, 20.20 g), sodium persulfate (238.10 g, Aldrich Chemical Co.), and sodium chloride (70.13 g) were added, with stirring, before the final pH was adjusted to 4.0 with 42.5 ml 4.0M sodium hydroxide.

Preparation Of Ferric Chelate Bleach F (Comparison).

To 0.5 liter of deionized water was added 1,3-propylenediaminetetraacetic acid (37.4 g) and glacial acetic acid (8.0 mL). Sufficient aqueous ammonium hydroxide was added to adjust the pH to 4.75, then ferric nitrate nonahydrate (44.85 g), 2-hydroxy- 1,3-propylenediaminetetraacetic acid (0.5 g), and ammonium bromide (25.0 g) were added. The solution was diluted to 1.0 liter and its pH adjusted to 4.75 with ammonium hydroxide.

Preparation Of Thiol Bleach Pre-Bath G (Comparison).

Distilled water (6.4 1) was combined with sodium metabisulfite (80 g), glacial acetic acid (200 ml), sodium acetate (80 g), ethylenedinitrilotetraacetatic acid tetrasodium salt (5.6 g) and dimethylaminoethanethiol, isothiouronium salt (44 g). The mixture was stirred to dissolve all solids and diluted to a total volume of 8 liters. This solution had a pH of 4.06.

Preparation Of Persulfate Bleach H (Comparison).

Distilled water (6.4 1) was combined with sodium persulfate (476 g), sodium chloride (70.1 g), glacial acetic acid (45.6 ml), and concentrated ammonium hydroxide (26 ml). The mixture was stirred to dissolve all solids and diluted to a total volume of 8 liters with a pH of 4.06.

Preparation Of Bleach Pre-Bath I (Invention).

Distilled water (6.4 l) was combined with dipicolinic acid (18.4 g), glacial acetic acid (45.6 ml), and sufficient 50% aq. sodium hydroxide (11.8 ml) to adjust the pH to 4.0. Ferric nitrate nonahydrate (20.2 g) was added, and the mixture was diluted to a total volume of 8 liters. Additional 50% aq. sodium hydroxide (4.3 ml) was added to adjust the final pH to 4.3.

Preparation Of Ferric Chelate Bleach J (Comparison).

To 0.7 liter deionized water was added 1,3-propylenediaminetetraacetic acid (15.35 g) and glacial acetic acid (6.0 mL). Sufficient 45% aqueous potassium hydroxide was added to adjust the pH to 5.0. Ferric nitrate nonahydrate (18.3 g) was added, followed by the addition of 2-hydroxy-1,3-propylenediaminetetraacetic acid (0.5 g) and potassium bromide (23.9 g). The pH was adjusted to 5.0 with aqueous ammonium hydroxide, and the solution was diluted to 1.0 liter with deionized water.

Preparation Of Persulfate Bleach K (Invention).

To 0.7 liter deionized water was added 2,6-pyridinedicarboxylic acid (5 g), glacial acetic acid (5.0 mL), and gelatin (0.5 g). Aqueous ammonium hydroxide was added to adjust the pH to 4.5. Ferric nitrate nonahydrate (5.5 g) was added, followed by sodium persulfate (15.0 g) and sodium bromide (7.6 g). Additional aqueous ammonium hydroxide was added to raise the pH to 4.6. The solution was diluted to 1.0 liter with deionized water.

Preparation Of Persulfate Bleach L (Comparison, DE 3,919, 550).

To 0.7 liter of deionized water was added citric acid (20.0 g) , ferric nitrate (16.0 g) , sodium persulfate (17.6 g) , sodium nitrate (20.0 g) , and sodium chloride (20.0 g). The solution was diluted to 1.0 liter and had a measured pH of about 1.

Preparation of Persulfate Bleach M (Invention).

To an eight liter stainless steel tank were added six liters of distilled water, 4-sulfophthalic acid (748 mL of a 1.07M aqueous solution), 2,6-pyridinedicarboxylic acid (18.36 g), and sufficient concentrated aqueous sodium hydroxide to adjust the pH to 3.5. This was followed by the addition of ferric nitrate nonahydrate (20.23 g), sodium persulfate (238.10 g), sodium chloride (116.88 g), and sufficient distilled water to make eight .liters. Aqueous sodium carbonate was used to adjust the final pH to 3.5.

Preparation of Persulfate Bleach N (Invention).

To a four liter stainless steel tank were added three liters of distilled water, 5-sulfoisophthalic acid monosodium salt (400 mL of a 1.00M aqueous solution), 2,6-pyridinedicarboxylic acid (9.19 g), and sufficient concentrated aqueous sodium hydroxide to adjust the pH to 3.5. This was followed by the addition of ferric nitrate nonahydrate (10.12 g), sodium persulfate (119.06 g), sodium chloride (58.44 g), and sufficient distilled water to make four liters. Aqueous sodium carbonate was used to adjust the final pH to 3.5.

Preparation of Persulfate Bleach O (Invention).

To a four liter stainless steel tank were added three liters of distilled water, 1,2,4-benzenetricarboxylic acid (84.05 g), 2,6-pyridinedicarboxylic acid (9.19 g), and sufficient concentrated aqueous sodium hydroxide to adjust the pH to 3.5. This was followed by the addition of ferric nitrate nonahydrate (10.15 g),, sodium persulfate (119.07 g), sodium chloride (58.46 g), and sufficient distilled water to make four liters. Aqueous sodium carbonate was used to adjust the final pH to 3.5.

Preparation of Persulfate Bleach P (Invention).

Two solutions were mixed separately, then combined to form eight liters of bleach. The first solution was prepared in a four liter beaker by mixing water (3.2 liters), sulfosuccinic acid (226.46 g of a 70% by weight aqueous solution), concentrated aqueous sodium hydroxide (sufficient to raise the pH to 4.0), sodium persulfate (238.10 g), and sodium chloride (116.88 g). The second solution was prepared in an eight liter titanium processing tank by mixing water (3.2 liters), 2,6-pyridinedicarboxylic acid (18.38 g), concentrated aqueous sodium hydroxide (sufficient to raise the pH to 4.0), ferric nitrate nonahydrate (20.20 g), and sodium carbonate (sufficient to raise the pH to 4.0). The first solution was added to the second, water was added to bring the volume to eight liters, and the pH was adjusted to 4.0 with sodium carbonate.

Preparation of Hydrogen Peroxide Bleach O (Invention).

To a four liter stainless steel processing tank was added water (2.5 liters), 2,6-pyridinedicarboxylic acid (9.20 g), concentrated aqueous sodium hydroxide (sufficient to raise the pH to 3.5), ferric nitrate nonahydrate (10.00 g), sodium carbonate (sufficient to raise the pH to 3.5), and sodium chloride (60.00 g). Shortly before processing, hydrogen peroxide (100 mL of a 30% by weight aqueous solution) was added along witch sufficient water to adjust the volume to 4.0 liters, and sufficient sodium carbonate to adjust the pH to 3.50.

EXAMPLE 2

Measurement of Bleaching Rates with a Flow-Cell Apparatus

Strips (35 mm×304.8 mm) of Kodacolor Gold 100 film were given a flash exposure on a 1B sensitometer (1/25 sec, 3000K. Daylight Va filter). The strips were developed and fixed (but not bleached) at 100° F. in standard color negative processing solutions, (see *British Journal of Photography*, p. 196, 1988), as shown below: t,0400

The film strips were air dried. To measure a bleaching rate, a 1.3 $cm^2$ round punch was removed from the strip and placed in a flow cell. This cell, 1 cm × 1 cm×2 cm, was constructed to hold the film punch in a UV/visible diode array spectrophotometer, enabling the visible absorption of the punch to be measured while a processing solution is circulated past the face of the punch. Both the processing solution (20 ml) and the cell were thermostated at 25° C. One hundred absorbance measurements (an average of the absorptions at 814, 816, 818, and 820 nm) were collected, typically, at five-second intervals over a 500-second span. The absorbance as a function of time was plotted, and the time required for 50% bleaching was determined graphically. Control experiments indicate that this flow cell method is an excellent predictor of bleaching rates in a standard process run at 37.7° C. (100° F.).

The data in Table 1, below, summarize bleaching rates for ferric-catalyzed persulfate bleaches prepared with a variety of ligands. The fastest bleaching rates are obtained with ligands of 25, the present invention. All bleaches contain 12.5 mM ferric ion, 27.5 mM ligand, 125 mM persulfate ion, 150 mM chloride ion, and 1000 mM total acetate buffer at pH 4.0. The preparations of these bleaches were analogous to the preparation of Bleach A in Example 1. Structures of ligands are given following Table 1. t,0410

EXAMPLE 3

Measurement of Bleaching Rates in Sink-line Process

Strips (35 mm×304.8 mm) of Kodacolor Gold 100 film were given a stepwise exposure on a 1B sensitometer (½ sec, 3000K, Daylight Va filter, 21 step 0–6 chart; step 1 corresponds to maximum exposure and maximum density). The following process using standard color negative processing solutions, except for the bleaches, was run at 37.8° C. (see *British Journal of Photography*, p. 196, 1988): t,0440

Film strips were air dried, and residual silver was determined at step 1 (maximum density) by X-ray fluorescence spectroscopy. Data for residual silver as a function of time in each bleach is presented in Table 2. It is apparent that bleach A rapidly converts silver to silver chloride, and the final silver level of 1.9 mg/ft$^2$ is low enough to have a negligible effect on the color contrast. Bleach B, which differs from bleach A only in the ligand, is almost completely inactive for bleaching silver. Bleach C, despite having an iron concentration three times greater than that of bleach A, bleaches silver more slowly than A, and leaves a final level of silver sufficient to adversely affect the color rendition of the film. t,0450

EXAMPLE 4

Bleaching Rate Data for Ammonium-Free Bleach Formulations

Bleaches D and E, with sodium counterion and 12.5 and 6.25 mM ferric ion as described above, were compared to Bleach F, corresponding to Kodak Flexicolor Bleach III, a commercially available bleach with ammonium counterion and 111/1 ferric ion. Strips (35 mm×304.8 mm) of Kodak Gold 100 film were given a stepwise exposure on a 1B sensitometer (½ sec, 3000K, Daylight Va filter, 21 step 0–6 chart; step 1 corresponds to maximum exposure and maximum density). The following process using standard color negative processing solutions, except for the bleaches, was run at 37.8° C. (see British Journal of Photography, p. 196, 1988): t,0460

Film strips were air dried, and residual silver was determined at step 1 (maximum density) by X-ray fluorescence. Data for residual silver as a function of time in each bleach is presented in Table 3. As expected, bleach F rapidly bleaches silver in the maximum density region of the film. However, bleaches D and E, which contain, respectively, only 11.3 and 5.6% as much ferric ion and no ammonium ion, also bleach the film rapidly. This example also demonstrates the catalytic activity of the ferric complex of 2-pyridinecarboxylate (picolinate). t,0470

EXAMPLE 5

Incorporation of the Ferric Complex into a Photographic Element

This example illustrates that the ferric complex catalyst need not be present in the bleach itself but may be introduced via incorporation in the photographic element. It further illustrates that the ferric complex catalyst is beneficially used in conjunction with known aminoalkyl thiol bleach accelerators.

Multilayer, multicolor *Photographic Sample* 101 (PE101) was prepared by applying the following layers sequentially to a clear acetate support:

Layer 1 (antihalation layer): comprising red, green, blue, and UV-light absorbing permanent and soluble dyes, grey silver, and gelatin.

Layer 2 (low sensitivity red-sensitive layer): comprising red-sensitive silver halide emulsions, cyan dye-forming image couplers and gelatin.

Layer 3 (medium sensitivity red-sensitive layer): comprising red-sensitive silver halide emulsions, cyan dye-forming image couplers and gelatin.

Layer 4 (high sensitivity red-sensitive layer): comprising red-sensitive silver halide emulsions, cyan dye-forming image couplers and gelatin.

Layer 5 (interlayer): comprising gelatin.

Layer 6 (low sensitivity green-sensitive layer): comprising green-sensitive silver halide emulsions, magenta dye-forming image couplers and gelatin.

Layer 7 (medium sensitivity green-sensitive layer): comprising green-sensitive silver halide emulsions, magenta dye-forming couplers and gelatin.

Layer 8 (high sensitivity green-sensitive layer): comprising green-sensitive silver halide emulsions, magenta dye-forming image couplers and gelatin.

Layer 9 (yellow filter layer): comprising blue density yellow filter dye and gelatin.

Layer 10 (low sensitivity blue-sensitive layer): comprising blue-sensitive silver halide emulsions, yellow dye-forming image couplers and gelatin.

Layer 11 (high sensitivity blue-sensitive layer): comprising blue-sensitive silver halide emulsions, yellow dye-forming image couplers and gelatin.

Layer 12 (ultra-violet protective layer): comprising UV-light absorbing dyes, Lippmann emulsion and gelatin.

Layer 13 (overcoat): comprising matte beads, lubricants and gelatin.

The various layers of this sample further comprised development inhibitor releasing couplers, masking couplers, oxidized developer scavengers, soluble mercaptan releasing couplers, surfactants, sequestrants, anti-static agents, coating aids, soluble and fixed absorber dyes, stabilizers and such as are known in the art.

Photographic sample 101 comprised 4.38 g per m$^2$ of silver, as silver halide, and 19.95 g per m$^2$ gelatin. Both conventional and tabular-shaped grains were employed. The tabular-Shaped grains had aspect ratios ranging from about 5:1 to about 11:1. The silver bromoiodide grains comprised about 3 to 5 mol percent iodide.

Photographic Sample 102 (PE 102) was like Photographic Sample 101 except that 0.151 g per m$^2$ of iron pyridine dicarboxylic acid was added, as a water solution, to layer 1 during coating preparation.

Photographic Sample 103 (PE 103) was like Photographic Sample 101 except that 0.303 g per m$^2$ of iron pyridine dicarboxylic acid was added, as a water solution, to layer 1 during coating preparation.

The couplers used in Photographic Samples 101, 102, and 103 were couplers C-2, C-9, C-11, C-13, C-15, C-25, C-26, C-29, C-30, C-34, and C-35.

Film strips (35 mm×304.8 mm) were given a stepwise exposure on a 1B sensitometer (½ sec, 3000 K, Daylight Va filter, 21 Step 0–6 chart; step 1 corresponds to maximum exposure and maximum density). A process using standard color negative processing solutions (see *British Journal of Photography*, p. 196, 1988), except for a dimethylaminoethanethiol bleach accelerator and a persulfate bleach (see above for bleach and bleach pre-bath preparations) was run at 37.8° C: t,0500

Film strips were air dried, and residual silver was determined at steps 1, 2, 3, (maximum density) by X-ray fluorescence spectroscopy. Data for residual silver at zero and 30 seconds bleaching is presented in Table 4. t,0510

It is apparent that, in a persulfate bleach preceded by a thiol pre-bath known in the art, bleaching occurs more rapidly when the ferric complex catalyst is present in the photographic element.

EXAMPLE 6

Employment of Ferric Complex Catalyst in a Bleach Pre-Bath

This example shows that the ferric complex catalyst can accelerate bleaching when it is introduced via a bleach pre-bath. This data also shows that bleach acceleration comparable to that of a known thiol bleach accelerator can be obtained without the unpleasant odor associated with the thiol.

Strips (35 mm×304.8 mm) of Kodacolor Gold 100 and Gold 100 Plus films were given a stepwise exposure on a 1B sensitometer (½ sec, 3000K, Daylight Va filter, 21 step 0–6 chart; step 1 corresponds to maximum exposure and maximum density). Three processes were run at 37.8° C. using standard color negative processing solutions, (see *British Journal of Photography*, p. 196, 1988), differing only in the composition of the bleach pre-bath (see Example 1 for composition and preparation of pre-bath G and bleach H and bleach pre-bath I): t,0520

Film strips were air dried, and residual silver was determined at steps 1, 2, 3 (maximum density) by X-ray fluorescence spectroscopy. Data for residual silver at zero and 30 seconds bleaching as a function of pre-bath and film is presented in Table 5. t,0521

Lower values of residual silver after 30" in the bleach correspond to greater bleaching rates. It is apparent that bleaching is extremely slow in that absence of a bleach pre-bath. For the two films in this example, the ferric complex catalyst pre-bath (pre-bath I) is as good as or better than the thiol pre-bath (pre-bath G) with respect to accelerating the persulfate bleach, yet the ferric catalyst pre-bath does not have an offensive odor like that of the thiol pre-bath. It should be noted that the ferric catalyst pre-bath is itself a very poor bleach; a control experiment showed that less than 6 mg $Ag/ft^2$ is bleached in either film during the 60" pre-bath I.

EXAMPLE 7

Bleaching of a Silver Chloride Photographic Element

This example demonstrates that a bleach formulation of the invention rapidly bleaches a silver chloride-based color paper and results in minimal retention of iron (a stain) in the element.

Kodak Ektacolor Edge Paper contains about 70 mg silver per square foot, of which greater than 95 mole percent is silver chloride. Strips (35×304.8 mm) of Kodak Ektacolor Edge Paper were given a stepwise exposure and processed as follows at 95° C.: t,0530

Bleach J is a comparison, representative of bleaches known and widely used in the art; bleach K is of the present invention; bleach L is a comparison representative of DE 3,919,550. Preparation of all the bleaches can be found in Example 1 above.

Measurements of silver by infrared density indicated that all three bleaches produced adequate bleaching after 50 seconds. Residual iron in the strips bleached for 90 seconds was determined by X-ray fluorescence spectroscopy. Values for retained iron as a function of bleach are given in Table 6 below: t,0540

These data show that bleach K of the invention provides rapid bleaching of a silver chloride-based color photographic paper and minimizes the stain associated with retained iron.

EXAMPLE 8

Bleaches With Aromatic Carboxylic Acid Buffers

Strips (35 mm×304.8 mm) of Kodacolor Gold Ultra 400 Film were given a flash exposure on a 1B sensitometer (½ sec, 3000K, Daylight Va filter, 21 step tablet, 0–6 density; step 1 corresponds to maximum exposure and maximum density). The following process using standard color negative processing solutions, except for the bleaches, was run at 37.8 C (See British Journal of Photography, p 196, 1988): t,0550

The film strips were dried, and residual silver was determined by x-ray fluorescence spectroscopy at steps 1, 2, and 3. The residual silver levels at these three steps were averaged to give the "Dmax silver" values in Table 7. It is evident that good bleaching was achieved with the aromatic carboxylic acid buffered bleaches of the invention. t,0551

EXAMPLE 9

A silver halide color paper, containing 2-equivalent magenta coupler C-38, in the form of strips that were 305 mm long and 35 mm wide, was given a suitable exposure to light and then processed using Kodak's Process-RA solutions, as described in the British Journal of Photography, p. 191 (1988), except for the bleaches. t,0560

The following bleach formulations were used: t,0570

The pH was adjusted with either 7N Sulfuric Acid or 10% Sodium Carbonate.

Residual silver was determined at step 1 (maximum density) by X-ray fluorescence spectroscopy. Data for residual silver in each bleach are presented in Table 8. It is apparent t:hat Bleaches P, Q and R of the invention remove silver from the paper more rapidly than does Bleach S. t,0571

EXAMPLE 10

Strips (35 mm×304:.8 mm) of Kodacolor Gold Ultra 400 film were given a stepped exposure on a 1B sensitometer (1/100 sec, 3000K., Daylight Ca filter, 21 step tablet, 0–4 density; step 1 corresponds to maximum exposure and maximum density). The following process using standard color negative processing solutions, except for the bleaches, was run at 37.8 C. (see British Journal of Photography, p 196, 1988): t,0580

The film strips were dried, and residual silver was determined by x-ray fluorescence spectroscopy at steps 2, 3, and 4. The residual silver levels at these three steps were averaged to give the "Dmax Silver" values in Table 9. This example demonstrates the use of an effective and economical buffer, sulfosuccinic acid. t,0590

EXAMPLE 11

Strips (35 mm×304.8 mm) of Kodacolor Gold Plus 100 film were given a stepped exposure on a 1B sensitometer (½ sec, 3000K., Daylight Va filter, 21 step tablet, 0–4 density; step 1 corresponds to maximum exposure and maximum density). The following process using standard color negative processing solutions, except for the bleaches, was run at 37.8 C. (see British Journal of Photography, p 196, 1988): t,0591

The film strips were dried, and residual silver was determined by x-ray fluorescence spectroscopy at steps 2, 3, and 4. The residual silver levels at these three steps were averaged to give the "Dmax Silver" values in Table 10. This example demonstrates excellent silver bleaching in a ferric-catalyzed, chloride-rehalogenating bleach using hydrogen peroxide instead of persulfate. t,0600

The invention has been described in detail with particular reference to preferred embodiments thereof, but it will be understood that variations and modifications can be effected within the spirit and scope of the invention.

What is claimed is:

1. A bleaching composition for color silver halide photographic elements, said bleaching composition comprising a peracid or peracid bleaching agent salt and an accelerating amount of a complex of ferric ion and a 2-pyridinecarboxylic acid or a 2,6-pyridinedicarboxylic acid.

2. The composition of claim 1 wherein the peracid salt is a persulfate salt.

3. The composition of claim 1 wherein the peracid is hydrogen peroxide or a hydrogen peroxide precursor.

4. The composition of claim 1 wherein the 2-pyridinecarboxylic acid or 2,6-pyridinedicarboxylic acid is of the formula: t,0610 wherein $X_1$, $X_2$, $X_3$ and $X_4$ are independently H, OH, $CO_2M$, $SO_3M$, or $PO_3M$, and M is H or an alkali metal cation.

5. The composition of claim 4 wherein $X_1$, $X_2$, $X_3$ and $X_4$ are H.

6. The composition of claim 1 wherein the concentration of the ferric ion is 0.001 to 0.100M and the concentration of the 2-pyridinecarboxylic acid or 2,6-pyridinedicarboxylic acid is 0.001 to 0.500M.

7. The composition of claim 6 wherein the concentration of the ferric ion is 0.001 to 0.025M and the concentration of the 2-pyridinecarboxylic acid or 2,6-pyridinedicarboxylic acid is 0.001 to 0.100M.

8. The composition of claim 1 wherein the pH of the composition is 3 to 6.

9. The composition of claim 2 wherein the concentration of the persulfate salt is 0.05 to 0.500M.

10. The composition of claim 3 wherein the concentration of the hydrogen peroxide or the hydrogen peroxide precursor is 0.10 to 2.0M.

11. The composition of claim 1 further comprising halide ion at a concentration of 0.025 to 2.0M.

12. The composition of claim 11 wherein the halide is chloride.

13. The composition of claim 11 wherein the concentration of halide ion is 0.050 to 0.500M.

14. The composition of claim 8 wherein the the bleach solution further comprises an aliphatic carboxylic acid buffer, an aromatic carboxylic acid buffer, a sulfo-substituted aliphatic carboxylic acid buffer or a sulfo-substituted aromatic carboxylic acid buffer such that the basic form of the buffer is less than 0.5M.

15. The composition of claim 1 wherein the composition comprises:

sodium persulfate at a concentration of 0.050 to 0.500M;

halide ion at a concentration of 0.025 to 2.00M;

and a complex of ferric ion at a concentration of 0.001 to 0.100M and a 2-pyridinecarboxylic acid or 2,6-pyridinedicarboxylic acid at a concentration of 0.001 to 0.500M;

the bleaching composition having a pH of 3 to 6.

16. The composition of claim 15 wherein the 2-pyridinecarboxylic acid or 2,6-pyridinedicarboxylic acid is of the formula: t,0640 wherein $X_1$, $X_2$, $X_3$ and $X_4$ are independently H, OH, $CO_2M$, $SO_3M$, or $PO_3M$, and M is H or an alkali metal cation.

17. The composition of claim 1 wherein the composition comprises: hydrogen peroxide at a concentration of 0.10 to 2.0M;

halide ion at a concentration of 0.025 to 2.00M;

and a complex of ferric ion at a concentration of 0.001 to 0.100M and a 2-pyridinecarboxylic acid or 2,6-pyridinedicarboxylic acid at a concentration of 0.001 to 0.500M;

the bleaching composition having a pH of 3 to 6.

18. The composition of claim 17 wherein the 2-pyridinecarboxylic acid or 2,6-pyridinedicarboxylic acid is of the formula: t,0650 wherein $X_1$, $X_2$, $X_3$ and $X_4$ are independently H, OH, $CO_2M$, $SO_3M$, or $PO_3M$, and M is H or an alkali metal cation.

19. The composition of claim 1 wherein the composition comprises:

sodium persulfate at a concentration of 0.050 to 0.500M;

chloride ion at a concentration of 0,050 to 0,500M;

and a complex of ferric ion at a concentration of 0.001 to 0.025M and an unsubstituted 2-pyridinecarboxylic acid or 2,6-pyridinedicarboxylic acid at a concentration of 0.001 to 0.100M;

the bleaching composition having a pH of 3 to 6.

20. The composition of claim 1 wherein the composition comprises:

hydrogen peroxide at a concentration of 0.10 to 2.0M;

chloride ion at a concentration of 0.050 to 0.500 M;

and a complex of ferric ion at a concentration of 0.001 to 0.025M and an unsubstituted 2-pyridinecarboxylic acid or 2,6-pyridinedicarboxylic acid at a concentration of 0.001 to 0.100M;

the bleaching composition having a pH of 3 to 6.

21. A method of processing an imagewise exposed and developed color photographic element comprising contacting the photographic element with the bleaching composition of claim 1.

22. The method of claim 21 wherein the photographic element comprises a 2-equivalent magenta coupler.

23. The method of claim 21 wherein the bleach composition is a bleaching composition as claimed in any one of claims 2 through 20.

24. A method of processing an imagewise exposed and developed color photographic element comprising contacting the photographic element with a bleach prebath solution comprising a complex of ferric ion and a 2-pyridinecarboxylic acid or a 2,6-pyridinedicarboxylic acid, and subsequently contacting the photographic element with a peracid bleaching solution.

25. The method of claim 24 wherein the 2-pyridinecarboxylic acid or 2,6-pyridinedicarboxylic acid is of the formula: t,0670 wherein $X_1$, $X_2$, $X_3$ and $X_4$ are independently H, OH, $CO_2M$, $SO_3M$, or $PO_3M$, and M is H or an alkali metal cation.

26. The method of claim 24 wherein the concentration of the ferric ion is 0.001 to 0.100M and the concentration of the 2-pyridinecarboxylic acid or 2,6-pyridinedicarboxylic acid is 0.001 to 0.500M.

27. The method of claim 22 wherein the 2-equivalent magenta coupler has the structure t,0680

* * * * *

UNITED STATES PATENT AND TRADEMARK OFFICE

CERTIFICATE OF CORRECTION

PATENT NO. : 5,460,924
DATED : October 24, 1995
INVENTOR(S) : Buchanan, et al

It is certified that error appears in the above-identified patent and that said Letters Patent is hereby corrected as shown below:

Delete columns 1 - 16, should be deleted and replaced with the attached pages.

Signed and Sealed this

Twenty-fifth Day of June, 1996

*Attest:*

Bruce Lehman

BRUCE LEHMAN

*Attesting Officer*

*Commissioner of Patents and Trademarks*

PHOTOGRAPHIC PERACID BLEACHES WITH FERRIC 2-PYRIDINECARBOXYLATE AND 2,6-PYRIDINECARBOXYLATE CATALYSTS

CROSS-REFERENCE TO RELATED APPLICATIONS

This Application is a continuation-in-part of U.S. application Ser. No. 08/101,136 filed Aug. 2, 1993, now abandoned, which is a continuation-in-part of application Ser. No. 07/990,500 filed Dec. 14, 1992, now abandoned.

FIELD OF THE INVENTION

This invention relates to the processing of color silver halide photographic elements. It more specifically relates to the use of bleach catalysts contained in processing solutions or the photographic elements themselves.

BACKGROUND OF THE INVENTION

The silver bleach solutions most commonly used for silver halide photographic elements use ferric complexes to oxidize silver metal to silver halide. It is environmentally desirable to reduce the concentrations and absolute amounts of iron and chelating agents discharged from processing machines, but simply reducing the iron and chelate concentrations results in unacceptable bleach performance. Persulfate bleaches are an alternative to iron-based bleaches, but they are slow acting unless used with bleach accelerators. Most of the commonly used accelerators are low molecular weight thiols which often have undesirable odors and are unstable if incorporated directly into the persulfate bleach.

German Patent Application DE 39 19 551 A1 describes certain persulfate bleaches incorporating a ferric salt, a chelating agent which may be an aminocarboxylic acid, a hydroxycarboxylic acid or a hydroxylpolycarboxylic acid, and a chloride rehalogenating agent. These formulations, however, slowly and incompletely bleach photographic elements with substantial contents of silver bromide and silver iodide. Another disadvantage of these bleaches is that they exhibit the best bleaching performance at low pH values (pH<3), where persulfate suffers acid catalyzed decomposition. This results in poor stability of the bleaches.

Japanese Kokai No. J5 0026-542 describes a bleaching solution containing an iron chelate and a 2-carboxypyridine. Japanese Kokai No. J5 1007-930 describes a process wherein either the bleach, the fix, or the wash can contain a pyridine-2,6-dicarboxylic acid. Japanese Kokai No. J5 3048-527 describes a bleach containing an aminopolycarboxylic acid metal complex salt and/or a pyridine-2,6-dicarboxylic acid salt. European Patent Application 0 329 088 describes a bleach containing, as one of numerous possible buffers, picolinic acid. None of the above references describe the use of a peracid bleach.

It is desirable to provide a peracid bleaching solution with low metal and ligand concentrations that rapidly and completely bleaches silver halide photographic elements containing a wide variety of silver halide compositions. It is further desirable to provide a ferric-catalyzed persulfate bleach exhibiting excellent silver bleaching at pH values greater than 3, where acid-catalyzed decomposition of persulfate is negligible.

SUMMARY OF THE INVENTION

This invention provides a bleaching composition for color photographic elements, said bleach comprising a peracid or peracid salt and an accelerating amount of a complex of ferric ion and a 2-pyridinecarboxylic acid or a 2,6-pyridinedicarboxylic acid.

It further provides a method of processing a color photographic element comprising bleaching the photographic element in a peracid bleach solution in the presence of a complex of ferric ion and a 2-pyridinecarboxylic acid or a 2,6-pyridinedicarboxylic acid. In one embodiment, the complex of ferric ion and a 2-pyridinecarboxylic acid or a 2,6-pyridinedicarboxylic acid is contained in the bleach solution. In another embodiment, the complex of ferric ion and a 2-pyridinecarboxylic acid or a 2,6-pyridinedicarboxylic acid is in a solution preceding the bleaching solution. In a further embodiment, the complex of ferric ion and a 2-pyridinecarboxylic acid or a 2,6-pyridinedicarboxylic acid is contained in the photographic element being processed.

This invention also provides a photographic element comprising at least one light sensitive silver halide emulsion layer and a complex of ferric ion and a 2-pyridinecarboxylic acid or a 2,6-pyridinedicarboxylic acid.

Ferric complexes of substituted and unsubstituted 2-pyridinecarboxylic acid and 2,6-pyridinedicarboxylic acid are outstanding catalysts for peracid bleaching. They remove silver more rapidly and completely than other ferric-catalyzed bleaches described in the art. Rapid, essentially complete silver bleaching is achieved even with metal and ligand concentrations ten to twenty times lower than those of current iron-based bleaches. These bleaches are suitable for photographic elements with a variety of silver chloride, silver bromide, and silver iodide contents. In addition to being employed directly within the bleach, the ferric complexes can accelerate bleaching when coated directly in the film or introduced to the film from a processing solution that precedes the bleach.

Furthermore, they can be formulated without environmentally damaging ammonium ion and are sufficiently active to function with chloride as the rehalogenating agent, thus offering cost and health advantages over bromide-containing persulfate bleaches. Two of the preferred ligands, picolinic and dipicolinic acids, have been shown to be readily biodegradable and yet are remarkably stable toward oxidative decomposition in the presence of persulfate.

DETAILED DESCRIPTION OF THE INVENTION

Ferric complexes of substituted or unsubstituted 2-pyridinecarboxylic acid (I) and substituted or unsubstituted 2,6-pyridinedicarboxylic acid (II) may be used in small quantities to catalyze the silver bleaching activity of peracid bleaches. The substituents may be independently hydrogen, substituted or unsubstituted alkyl or aryl groups, chloro, nitro, sulfoamido, amino, carboxylic acid, sulfonic acid, phosphoric acid, hydroxy, or any other substituent that does not interfere with ferric complex formation, stability, solubility or catalytic activity. The substituents may also be the atoms necessary to form a ring between any of the positions. The substituents may be chosen for the express purpose of increasing the aqueous solubility of the ferric complex.

The preferred substituted or unsubstituted 2-pyridinecarboxylic acid and 2,6-pyridinedicarboxylic acids are of the following formula:

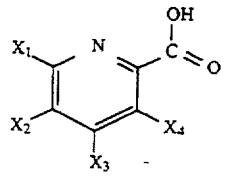

I

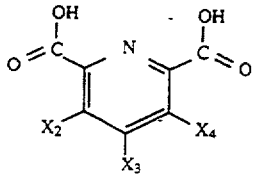

II wherein $X_1$, $X_2$, $X_3$ and $X_4$ are independently H, OH, or $CO_2M$, $SO_3M$, or $PO_3M$, and M is H or an alkali metal cation. In the most preferred embodiment, $X_1$, $X_2$, $X_3$ and $X_4$ are H, e.g., the most preferred acids are unsubstituted 2-pyridinecarboxylic acid (picolinic acid) and unsubstituted 2,6-pyridinedicarboxylic acid.

The complexes may be prepared and isolated as their ammonium or alkali metal salts, or they can be synthesized in situ as part of the bleach preparation. The components and the complexes are commercially available, or they may be synthesized by methods known to those skilled in the art. For example, synthesis of

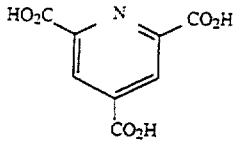

is described in L. Syper, K. Kloc, J. Mlochowski, *Tetrahedron*, 1980, vol. 36, pp. 123–129, and R. M. Engelbrecht, U.S. Pat. No. 3,766,258, Oct. 16, 1973, p. 8. Synthesis of

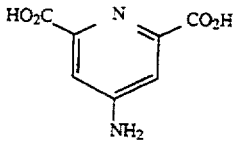

is described in J. S. Bradshaw et al., *J. Am. Chem. Soc.*, 1980, 102(2), pp. 467–74.

The ferric complexes may also be generated from the corresponding ferrous complexes or formed in situ from the ligand and a ferrous ion salt. The complexes and their components may be added by any method as known in the art, for example, dry pyridinedicarboxylic acid and a ferric salt may be added to a bleach solution or the ferric-bis-2,6-pyridinedicarboxylate complex may be prepared and isolated as its sodium salt, which is then added to the bleach.

Typical peracid bleaches useful in this invention include the hydrogen, alkali and alkali earth salts of persulfate, peroxide, perborate, perphosphate, and percarbonate, oxygen, and the related perhalogen bleaches such as hydrogen, alkali and alkali earth salts of chlorate, bromate, iodate, perchlorate, perbromate and metaperiodate. Examples of formulations using these agents are described in *Research Disclosure*, December 1989, Item 308119, published by Kenneth Mason Publications, Ltd., Dudley Annex, 12a North Street, Emsworth, Hampshire P010 & DQ, England.

the disclosures of which are incorporated herein by reference. This publication will be identified hereafter as *Research Disclosure*.

Additional hydrogen peroxide formulations are described in U.S. Pat. Nos. 4,277,556; 4,328,306; PCT/EP91/01377 (filed 24 Jul. 1991) of Marsden et al.; PCT/EP91/01973 (filed 17 Oct. 1991) of Fyson et al.; U.S. Pat. Nos. 4,454,224; 4,717,649. Especially preferred are persulfate bleaches and peroxide bleaches, with sodium, potassium, or ammonium persulfate being particularly preferred. For reasons of economy and stability, sodium persulfate is most commonly used. The preferred peroxide is hydrogen peroxide.

In a preferred embodiment, the ferric complexes are contained in the peracid bleach. These bleaches may contain ferric ion at a concentration of 0.001 to 0.100M and more preferably at a concentration of 0.001 to 0.025M; ligand at a concentration of 0.001 to 0.500M and more preferably at a concentration of 0.001 to 0.100M; persulfate ion at a concentration of 0.020 to 2.0M and more preferably at a concentration of 0.050 to 0.500M. Hydrogen peroxide, its salts or precursors may be partially or fully substituted for persulfate ion in these bleaches. The preferred concentration of peroxide is 0.1 to 2.0M, and more preferably 0.2 to 1.0M. Preferably, the bleaches also contain halide ion at a concentration of 0.025 to 2.0 M, with a preferred concentration of 0.050 to 0.500M. Chloride is the preferred halide ion because, while it still enables rapid bleaching,, it costs less than bromide, provides possible fixing advantages, and avoids health concerns associated with the oxidation of bromide to bromine. While faster silver bleaching may sometimes be obtained with constituent concentrations higher than those specified above as preferred, the lower concentrations may be preferred for environmental and economic reasons.

The preferred pH of the bleach composition is between 3 and 6. The pH may be maintained with any of a variety of organic or inorganic buffers, as long as the buffer has at least one $P_{Ka}$ value between 1.5 and 7.5 (preferably 3 to 6) and does not substantially disrupt the complexation of ferric ion by the pyridinecarboxylate ligand. Furthermore, the buffer should not be readily oxidized by the bleaching composition nor should it adversely affect image and masking dyes. It is to avoid such dye interactions that preferred buffers such as aliphatic or aromatic carboxylic acid buffers, and particularly sulfo-substituted aliphatic and aromatic carboxylic acid buffers are preferably used at concentrations and pH values such that the concentration of the basic form of the buffer (e.g., acetate ion) is less than 0.5M, and more preferably less than 0.2M. Examples of useful buffers are acetate, 2-methyllactate, phthalate, 4-sulfophthalate, 5-sulfoisophthalic acid, sulfoacetate, sulfosuccinate and trimellitate. In one embodiment, the ligand may also serve as the buffer. Preferably, a stop or stop-accelerator bath of pH≦7 precedes the bleaching step.

Examples of counterions which may be associated with the various salts in these bleaching solutions are sodium, potassium, ammonium, and tetraalkylammonium cations. It may be preferable to use alkali metal cations (especially sodium and potassium cations) in order to avoid the aquatic toxicity associated with ammonium ion. In some cases, sodium may be preferred over potassium to maximize the solubility of the persulfate salt. Additionally, the bleaching solution may contain anti-calcium agents, such as, e.g., 1-hydroxyethyl-1, 1-diphosphonic acid, that do not substantially interfere with ferric ion complexation by the ligand; chlorine scavengers such as those described in G. M. Einhaus and D. S. Miller, *Research Disclosure*, 1978, vol 175, p. 42, No. 17556; and corrosion inhibitors, such as nitrate ion, as needed. The bleaching compositions described here may be formulated as the working bleach solutions, solution concentrates, or dry powders. The bleach compositions of this invention can adequately bleach a wide variety of photographic elements in 30 to 240 seconds.

The ferric complexes may also be contained in a bleach pre-bath or other processing solution that precedes the bleach. This could include, for example, a wash bath, a stop bath, or the developer itself. Preferably, the complexes should be contained in a (dedicated) accelerator bath or a combination stop-accelerator bath. The concentration of the ferrous or ferric ion may be 0.001 to 0.100M, and the concentration of the 2-pyridinecarboxylic acid or 2,6-pyridinedicarboxylic acid may be 0.001 to 0.500M. Generally, the pH of the solutions preceding the bleach is less than 10 to prevent precipitation of the iron as rust. As for the persulfate solutions, ferric (ferrous) complexes may be added to the solutions preceding the bleach as solids or solutions of the preformed complexes or solids or solutions of the iron salt and ligand.

In another embodiment, the ferric complexes may be incorporated into a photographic element. The ferric complexes may be incorporated into any layer of the photographic element. It is preferred that the complexes be incorporated into layers which do not contain imaging silver (a non-imaging layer) such as interlayers or the antihalation layer. Depending on the solubility of the complexes, they may be added as aqueous solutions, gelatin dispersions, or solid particle dispersions.

The amount of the ferric ion contained in the photographic element may be 5 to 250 micromoles per $ft^2$, and the amount of the 2-pyridinecarboxylic acid or 2,6-pyridinedicarboxylic acid may be 5 to 500 micromoles per $ft^2$, with 10 to 100 micromoles per $ft^2$ being preferred.

The present invention may be used in combination with other known means of accelerating persulfate bleaches. Examples of bleach accelerator releasing couplers are described in EP 0,193,389-B, EP 0,310,125, and U.S. Pat. No. 4,842,994 and the references therein. Thiol and metal complex persulfate accelerators are described in *Research Disclosure* No. 15704,. vol. 157, p. 8 (May, 1977). Persulfate bleach acceleration by ammonium, sulfonium, and pyridinium salts is described by Willems in U.S. Pat. No. 3,748,136. Aromatic amine accelerators are described by Van Der Voorn and Willis in U.S. Pat. No. 3,707,374. Silver thiolate salts as bleach accelerators are described by Harder and Singer in U.S. Pat. No. 4,865,956. Other useful accelerators are described in U.S. Pat. No. 3,772,020 (Smith).

The photographic elements useful with this invention can be single-color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single-segmented layer, e.g., as by the use of microvessels as described in Whitmore, U.S. Pat. No 4,362,806, issued Dec. 7, 1982. The element can contain additional layers such as filter layers, interlayers, overcoat layers, subbing layers, and the like. Due to the decreased D-min associated with persulfate bleaches, this invention may be particularly useful with those photographic elements containing a magnetic backing such as described in No. 34390, *Research Disclosure*, November, 1992.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of the invention can include various couplers including, but not limited to, those described in Research Disclosure Section VII, paragraphs D, E, F, and G, and the publications cited therein. These couplers can be incorporated in the elements and emulsions as described in Research Disclosure Section VII, paragraph C, and the publications cited therein.

Other useful couplers include couplers which form magenta dyes upon reaction with oxidized color developing agents, which are described in such representative patents and publications as U.S. Pat. Nos. 2,600,788; 2,369,489; 2,343,703; 2,311,082; 2,908,573; 3,152,896; 3,519,429; 3,062,653; and T. H. James, editor, *The Theory of the Photographic Process*, 4th Edition, MacMillan, New York, 1977, pp. 356–358; couplers which form yellow dyes upon reaction with oxidized color developing agents, which are described in such representative patents and publications as U.S. Pat. Nos. 2,298,443; 2,875,057; 2,407,210; 3,048,194; 3,365,506; 3,447,928; 5,021,333; and *The Theory of the Photographic Process*, pp. 354–356; and couplers which form cyan dyes upon reaction with oxidized color developing agents are described in such representative patents as U.S. Pat. Nos. 4,009,038; 4,666,826; 5,006,453; 5,026,631; and European Patent EP 271,005. Further useful couplers include the following:

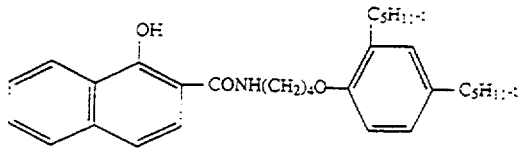

C-1

-continued
C-2
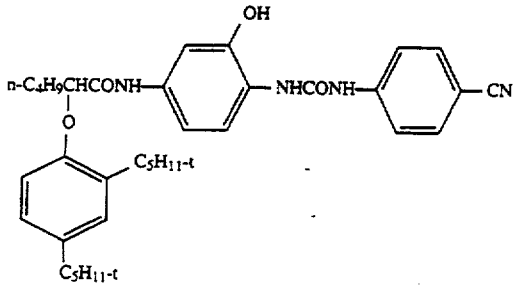
C-3
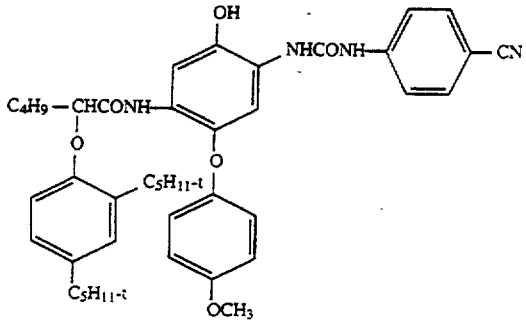
C-4
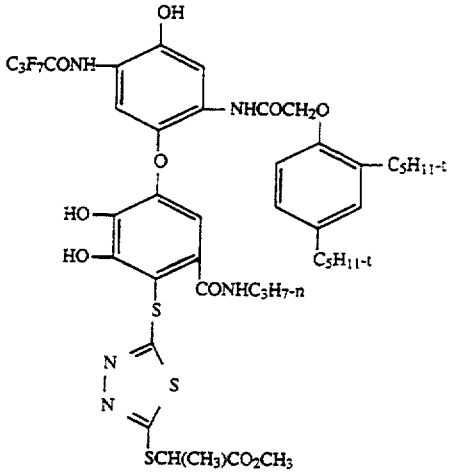
C-5
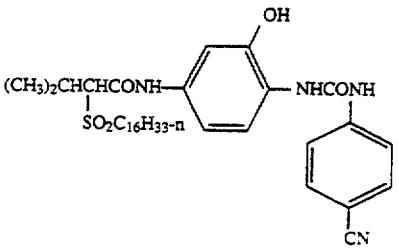
C-6
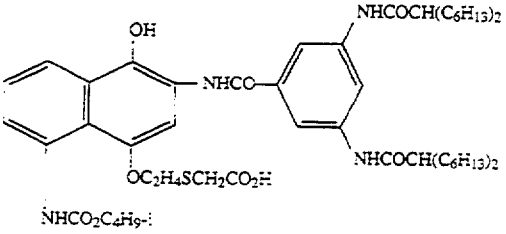

-continued
C-7
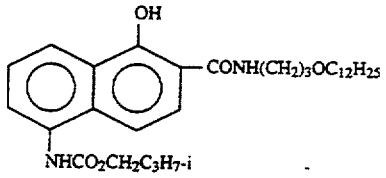
C-8
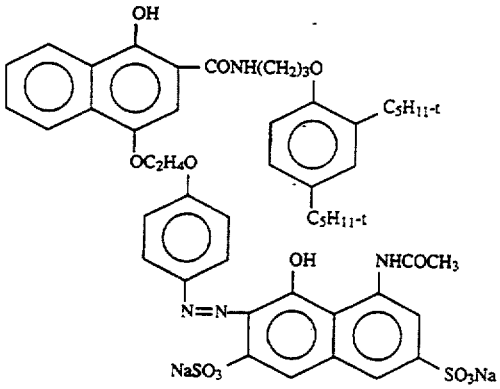
C-9
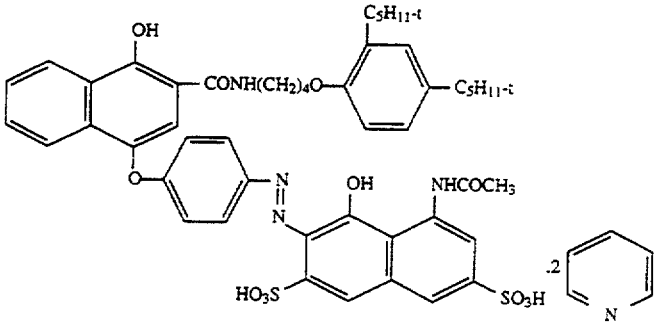
C-10
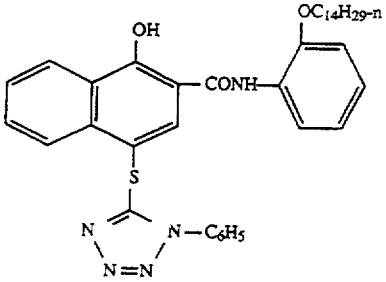
C-11
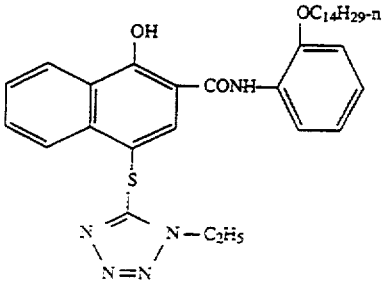

-continued
C-12
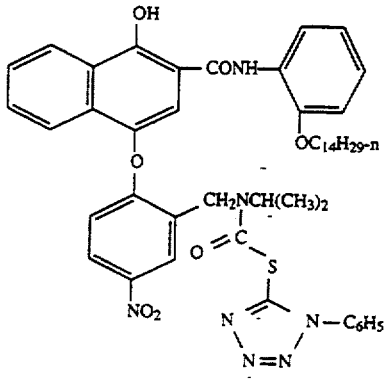
C-13
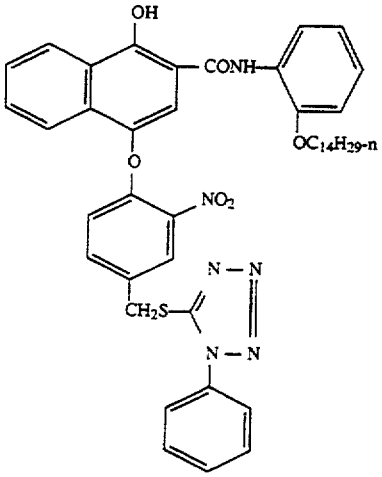
C-14
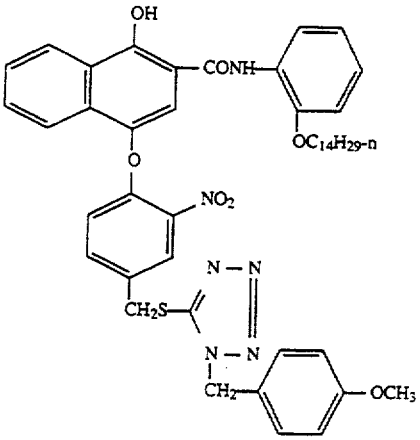
C-15
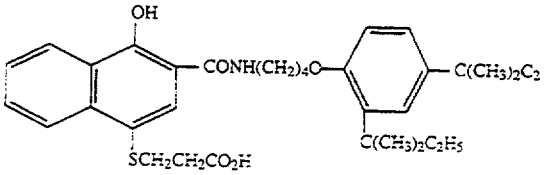

-continued
C-16
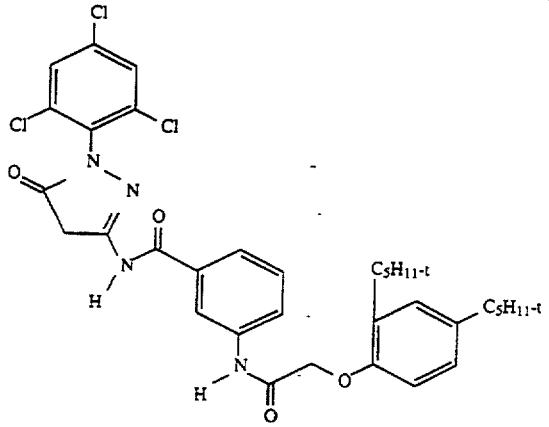
C-17
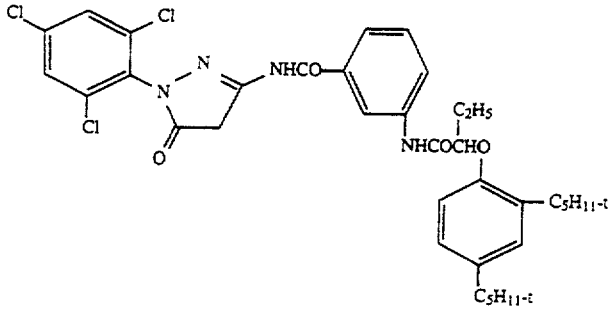
C-18
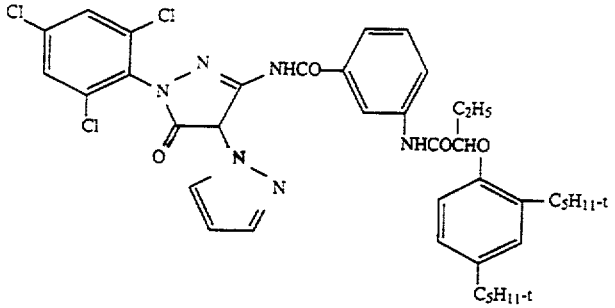
C-19
+R2
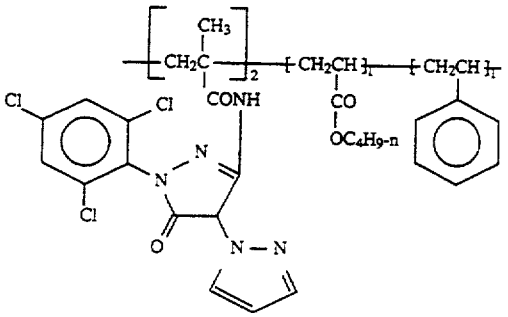

-continued
C-20
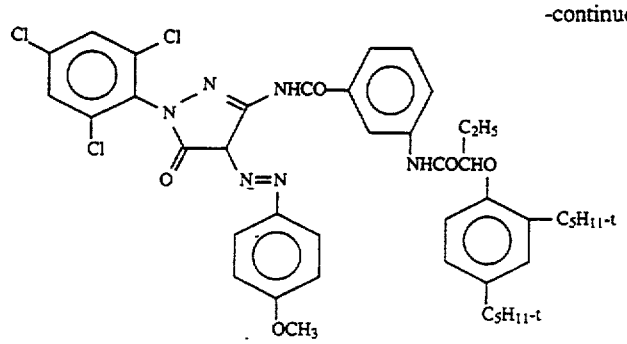
C-21
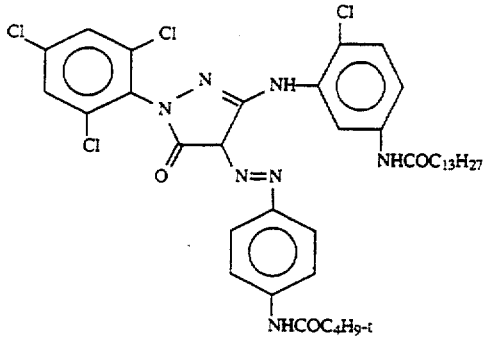
C-22
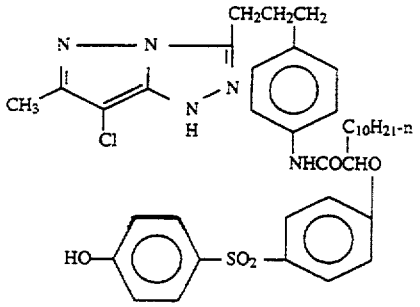
C-23
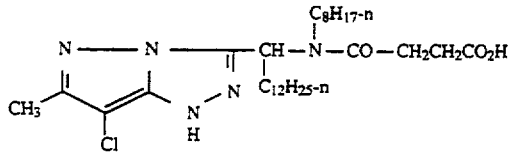
C-24
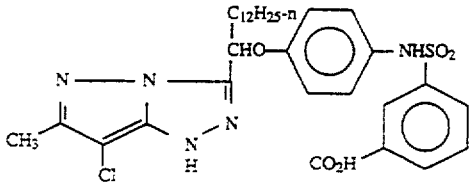

-continued
(cis and trans)
C-25
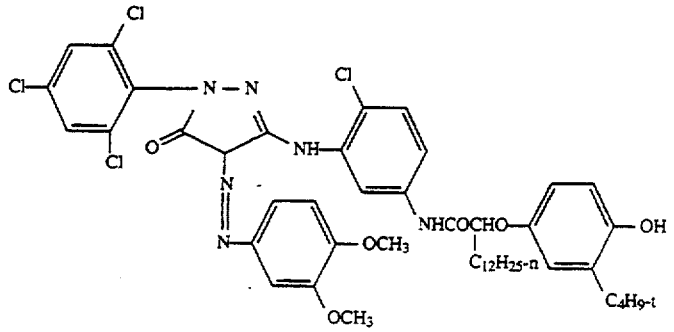
C-26
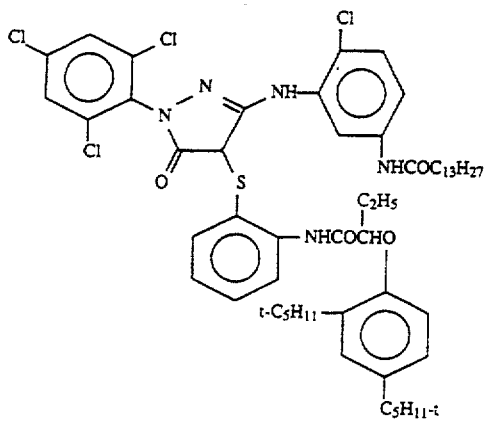
(cis and trans)
C-27
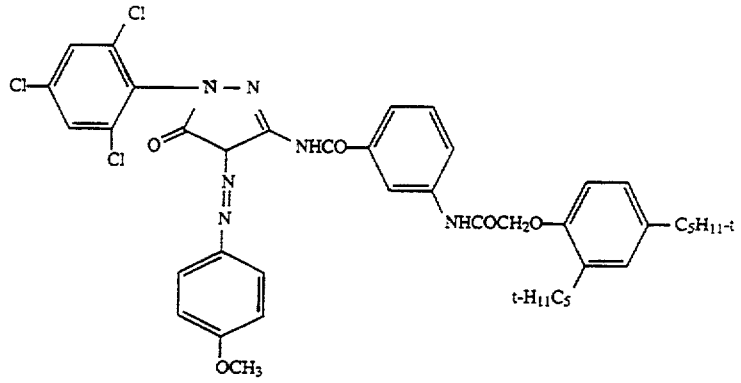
C-28
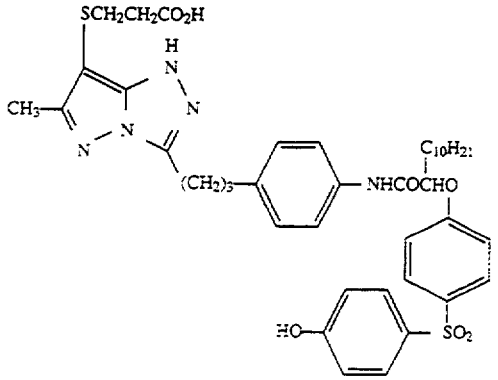

-continued
C-29
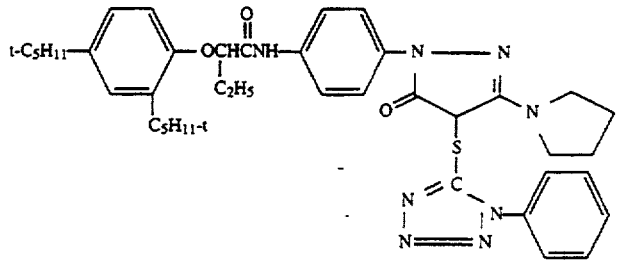
C-30
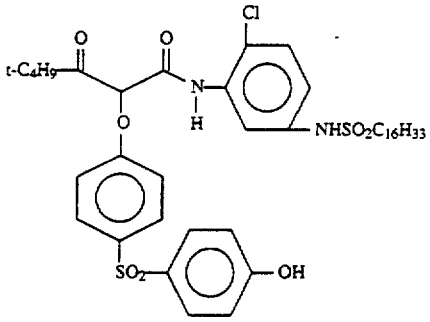
C-31
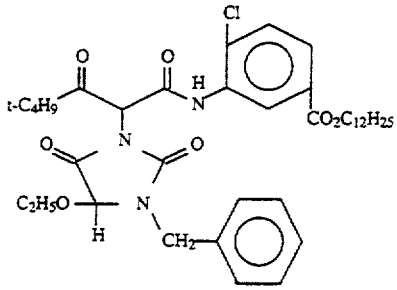
C-32
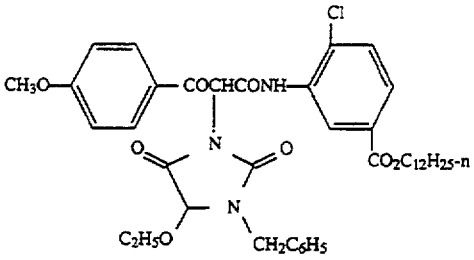
C-33
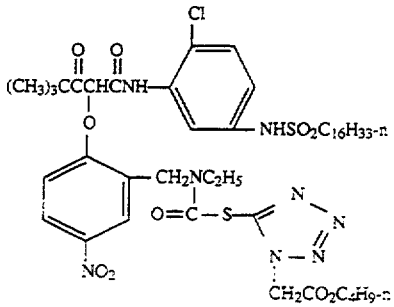

-continued
C-34
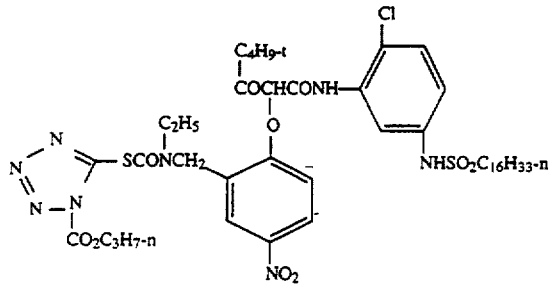
C-35
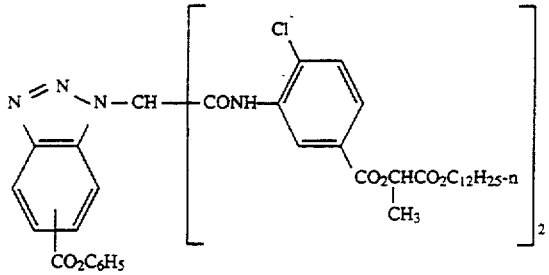
C-36
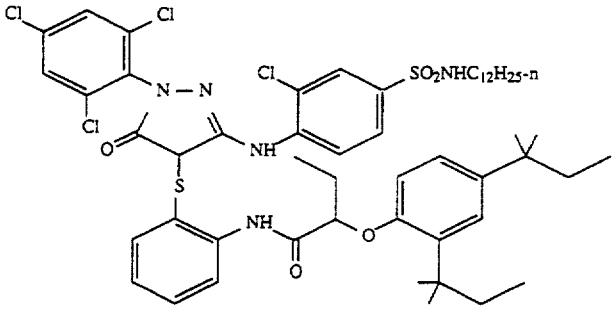
C-37
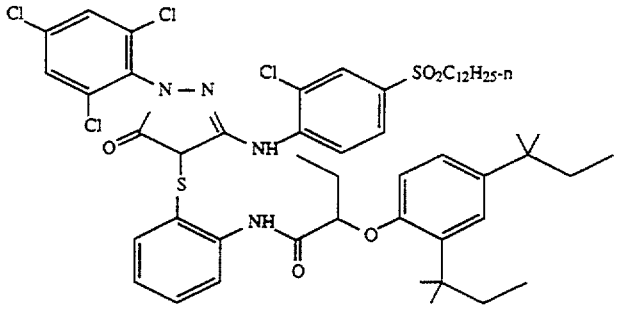
C-38
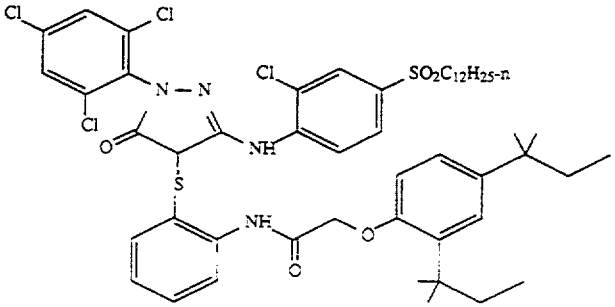
Two-equivalent couplers are useful with this invention, particularly coupler C-38.Magenta coupler C-38 can be prepared as described in U.S. Pat. No. 4,853,319 (Krishnamurthy) dated Aug. 1, 1989, hereby incorporated by reference, and *Research Disclosure*, Item 16736,March 1978, published by Kenneth Mason Publications, Ltd., Didley Annex, 12a North Street, Emsworth, Hampshire P010 & DQ, England.

The photographic elements of this invention or individual layers thereof can contain, among other things, brighteners (examples in Research Disclosure Section V), antifoggants and stabilizers (examples in Research Disclosure Section VI), antistain agents and image dye stabilizers (examples in Research Disclosure Section VII, paragraphs I and J), light absorbing and scattering materials (examples in Research Disclosure Section VIII), hardeners (examples in Research Disclosure Section X), plasticizers and lubricants (examples in Research Disclosure Section XII), antistatic agents (examples in Research Disclosure Section XIII), matting agents (examples in Research Disclosure Section XVI), and development modifiers (examples in Research Disclosure Section XXI).

The photographic elements can be coated on a variety of supports including, but not limited to, those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image, examples of which are described in Research Disclosure Section XIX. Processing to form a visible dye image includes the step of contacting the element with a color-developing agent to reduce developable silver halide and oxidize the color-developing agent. Oxidized color-developing agent, in turn, reacts with the coupler to yield a dye.

The color-developing solutions typically contain a primary aromatic amino color-developing agent. These color-developing agents are well known and widely used in variety of color photographic processes. They include aminophenols and p-phenylenediamines.

In addition to the primary aromatic amino color-developing agent, color-developing solutions typically contain a variety of other agents, such as alkalies to control pH, bromides, iodides, benzyl alcohol, antioxidants, antifoggants, solubilizing agents, brightening agents, and so forth.

Photographic color-developing compositions are employed in the form of aqueous alkaline-working solutions, having a pH of above 7, and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent for color-developing compositions.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching and fixing to remove silver and silver halide, washing, and drying.

Fixing agents include compounds which react with silver halide to form a water-soluble complex salt, e.g., thiosulfates such as potassium thiosulfate, sodium thiosulfate and ammonium thiosulfate; thiocyanates such as potassium thiocyanate, sodium thiocyanate and ammonium thiocyanate; thioureas; thioethers, and halides such as iodides.

The fixer may contain one or more pH buffers comprising various acids and salts such as boric acid, borax, sodium hydroxide, potassium hydroxide, sodium carbonate, potassium carbonate, sodium bicarbonate, potassium bicarbonate, acetic acid, sodium acetate and ammonium hydroxide, as well as fixing agent. Also, it is possible to add, as appropriate, substances known to be usually added to the fixer, such as pH buffers, e.g., borates, oxalates, acetates, carbonates, phosphates; alkylamines and polyethyleneoxides.

The above fixing agents are normally used at over 0.1 mol per l processing solution; from the viewpoint of the desired effect of the invention, it is preferable to use these agents in the range of from 0.6 to 4 mols, more preferably 0.9 to 3.0 mols, still more preferably 1.1 to 2.0 mols.

Typically, a separate pH lowering solution, referred to as a stop bath, is employed to terminate development prior to bleaching. A stabilizer bath is commonly employed for final washing and hardening of the bleached and fixed photographic element prior to drying. Conventional techniques for processing are illustrated by Research Disclosure, Paragraph XIX.

Preferred processing sequences for color photographic elements, particularly color negative films and color print papers, include the following:

(P-1) Color Development/Stop/Bleaching/Fixing/Washing/Stabilizing/Drying.

(P-2) Color Development/Stop/Bleaching/Fixing/Stabilizing/Drying.

(P-3) Color Development/Bleaching/Fixing/Washing/Stabilizing/Drying.

(P-4) Color Development/Bleaching/Fixing/Washing.

(P-5) Color Development/Bleaching/Fixing/Stabilizing/Drying.

(P-6) Color Development/Stop/Washing/Bleaching/Fixing/Washing/Drying.

In each of processes (P-1) to (P-6), variations are contemplated. For example, a bath can be employed prior to color development, such as a prehardening bath, or the washing step may follow the stabilizing step. Additionally, reversal processes which have the additional steps of black and white development, chemical fogging bath, light re-exposure, and washing before the color development are contemplated.

The following examples are intended to illustrate, without limiting, this invention.

EXAMPLE 1

Preparation of Bleaches and Bleach Pre-Baths Preparation Of Persulfate Bleach A (Invention).

To one liter of distilled water was added, with stirring, 2,6-pyridinedicarboxylic acid (9.19 g), ferric nitrate nonahydrate ($Fe(NO_3)_3.9H_2O$, 10.10 g), and glacial acetic acid (115 ml). Concentrated ammonium hydroxide (20 ml) was added dropwise, followed by sodium persulfate ($Na_2S_2O_8$, 59.525 g), and sodium chloride (NaCl, 17.53 g). Water was added to make 1.9 liters, and additional ammonium hydroxide (56 ml) was added to adjust the pH to a value of 4.0 at 40° C. Finally, water was added to adjust the final volume to 2.0 liters.

Preparation Of Persulfate Bleach B (Comparison).

To one liter of distilled water was added, with stirring, tetrasodium ethylenediaminetetraacetic acid (10.45 g), ferric nitrate nonahydrate ($Fe(NO_3)_3.9H_2O$, 10.10 g), and glacial acetic acid (115 ml), sodium persulfate ($Na_2S_2O_8$, 59.525 g), and sodium chloride (NaCl, 17.53 g). Concentrated ammonium hydroxide (63 ml) was added dropwise to adjust the pH to a value of 4.0 at 40° C., and water was added to bring the final volume to 2.0 liters.

Preparation Of Persulfate Bleach C (Comparison, DE 3,919,550).

To 1.7 liters of distilled water was added, with stirring, potassium persulfate ($K_2S_2O_8$, 40.0 g), citric acid (40.0 g), sodium chloride (NaCl, 40.0 g), and ferric nitrate nonahydrate ($Fe(NO_3)_3.9H_2O$, 32.0 g). A pH value of 1.07 was measured at 40° C., and water was added to adjust the final volume to 2.0 liters.

Preparation Of Bleach D (Invention).

To an eight liter stainless steel tank were added six liters of distilled water, 2,6-pyridinedicarboxylic acid (36.77 g), glacial acetic acid (45.8 ml), and, slowly, sufficient 4.0M aqueous sodium hydroxide (94.5 ml) to adjust the solution pH to 4.0. Ferric nitrate nonahydrate ($Fe(NO_3)_3.9H_2O$, 40.41 g), sodium persulfate (476.21 g), and sodium chloride (70.13 g) were added with stirring before the final pH was adjusted to 4.0 with 55 ml 4.0M sodium hydroxide.

Preparation Of Bleach E (Invention).

To an eight liter stainless steel tank were added six liters of distilled water, 2-pyridinecarboxylic acid ("picolinic acid", 40.63 g,), glacial acetic acid (45.8 ml), and, slowly, 4.0M aqueous sodium hydroxide (36.4 ml) sufficient to adjust the solution pH to 4.0. Ferric nitrate nonahydrate ($Fe(NO_3)_3.9H_2O$, 20.20 g), sodium persulfate (238.10 g, Aldrich Chemical Co.), and sodium chloride (70.13 g) were added, with stirring, before the final pH was adjusted to 4.0 with 42.5 ml 4.0M sodium hydroxide.

Preparation Of Ferric Chelate Bleach F (Comparison).

To 0.5 liter of deionized water was added 1,3-propylenediaminetetraacetic acid (37.4 g) and glacial acetic acid (8.0 mL). Sufficient aqueous ammonium hydroxide was added to adjust the pH to 4.75, then ferric nitrate nonahydrate (44.85 g), 2-hydroxy-1,3-propylenediaminetetraacetic acid (0.5 g), and ammonium bromide (25.0 g) were added. The solution was diluted to 1.0 liter and its pH adjusted to 4.75 with ammonium hydroxide.

Preparation Of Thiol Bleach Pre-Bath G (Comparison).

Distilled water (6.4 1) was combined with sodium metabisulfite (80 g), glacial acetic acid (200 ml), sodium acetate (80 g), ethylenedinitrilotetraacetatic acid tetrasodium salt (5.6 g) and dimethylaminoethanethiol, isothiouronium salt (44 g). The mixture was stirred to dissolve all solids and diluted to a total volume of 8 liters. This solution had a pH of 4.06.

Preparation Of Persulfate Bleach H (Comparison).

Distilled water (6.4 1) was combined with sodium persulfate (476 g), sodium chloride (70.1 g), glacial acetic acid (45.6 ml), and concentrated ammonium hydroxide (26 ml). The mixture was stirred to dissolve all solids and diluted to a total volume of 8 liters with a pH of 4.06.

Preparation Of Bleach Pre-Bath I (Invention).

Distilled water (6.4 l) was combined with dipicolinic acid (18.4 g), glacial acetic acid (45.6 ml), and sufficient 50% aq. sodium hydroxide (11.8 ml) to adjust the pH to 4.0. Ferric nitrate nonahydrate (20.2 g) was added, and the mixture was diluted to a total volume of 8 liters. Additional 50% aq. sodium hydroxide (4.3 ml) was added to adjust the final pH to 4.3.

Preparation Of Ferric Chelate Bleach J (Comparison).

To 0.7 liter deionized water was added 1,3-propylenediaminetetraacetic acid (15.35 g) and glacial acetic acid (6.0 mL). Sufficient 45% aqueous potassium hydroxide was added to adjust the pH to 5.0. Ferric nitrate nonahydrate (18.3 g) was added, followed by the addition of 2-hydroxy-1,3-propylenediaminetetraacetic acid (0.5 g) and potassium bromide (23.9 g). The pH was adjusted to 5.0 with aqueous ammonium hydroxide, and the solution was diluted to 1.0 liter with deionized water.

Preparation Of Persulfate Bleach K (Invention).

To 0.7 liter deionized water was added 2,6-pyridinedicarboxylic acid (5 g), glacial acetic acid (5.0 mL), and gelatin (0.5 g). Aqueous ammonium hydroxide was added to adjust the pH to 4.5. Ferric nitrate nonahydrate (5.5 g) was added, followed by sodium persulfate (15.0 g) and sodium bromide (7.6 g). Additional aqueous ammonium hydroxide was added to raise the pH to 4.6. The solution was diluted to 1.0 liter with deionized water.

Preparation Of Persulfate Bleach L (Comparison, DE 3,919,550).

To 0.7 liter of deionized water was added citric acid (20.0 g) , ferric nitrate (16.0 g) , sodium persulfate (17.6 g) , sodium nitrate (20.0 g) , and sodium chloride (20.0 g). The solution was diluted to 1.0 liter and had a measured pH of about 1.

Preparation of Persulfate Bleach M (Invention).

To an eight liter stainless steel tank were added six liters of distilled water, 4-sulfophthalic acid (748 mL of a 1.07M aqueous solution), 2,6-pyridinedicarboxylic acid (18.36 g), and sufficient concentrated aqueous sodium hydroxide to adjust the pH to 3.5. This was followed by the addition of ferric nitrate nonahydrate (20.23 g), sodium persulfate (238.10 g), sodium chloride (116.88 g), and sufficient distilled water to make eight liters. Aqueous sodium carbonate was used to adjust the final pH to 3.5.

Preparation of Persulfate Bleach N (Invention).

To a four liter stainless steel tank were added three liters of distilled water, 5-sulfoisophthalic acid monosodium salt (400 mL of a 1.00M aqueous solution), 2,6-pyridinedicarboxylic acid (9.19 g), and sufficient concentrated aqueous sodium hydroxide to adjust the pH to 3.5. This was followed by the addition of ferric nitrate nonahydrate (10.12 g), sodium persulfate (119.06 g), sodium chloride (58.44 g), and sufficient distilled water to make four liters. Aqueous sodium carbonate was used to adjust the final pH to 3.5.

Preparation of Persulfate Bleach O (Invention).

To a four liter stainless steel tank were added three liters of distilled water, 1,2,4-benzenetricarboxylic acid (84.05 g), 2,6-pyridinedicarboxylic acid (9.19 g), and sufficient concentrated aqueous sodium hydroxide to adjust the pH to 3.5. This was followed by the addition of ferric nitrate nonahydrate (10.15 g),, sodium persulfate (119.07 g), sodium chloride (58.46 g), and sufficient distilled water to make four liters. Aqueous sodium carbonate was used to adjust the final pH to 3.5.

Preparation of Persulfate Bleach P (Invention).

Two solutions were mixed separately, then combined to form eight liters of bleach. The first solution was prepared in a four liter beaker by mixing water (3.2 liters), sulfosuccinic acid (226.46 g of a 70% by weight aqueous solution), concentrated aqueous sodium hydroxide (sufficient to raise the pH to 4.0), sodium persulfate (238.10 g), and sodium chloride (116.88 g). The second solution was prepared in an eight liter titanium processing tank by mixing water (3.2 liters), 2,6-pyridinedicarboxylic acid (18.38 g), concentrated aqueous sodium hydroxide (sufficient to raise the pH to 4.0), ferric nitrate nonahydrate (20.20 g), and sodium carbonate (sufficient to raise the pH to 4.0). The first solution was added to the second, water was added to bring the volume to eight liters, and the pH was adjusted to 4.0 with sodium carbonate.

Preparation of Hydrogen Peroxide Bleach O (Invention).

To a four liter stainless steel processing tank was added water (2.5 liters), 2,6-pyridinedicarboxylic acid (9.20 g), concentrated aqueous sodium hydroxide (sufficient to raise the pH to 3.5), ferric nitrate nonahydrate (10.00 g), sodium carbonate (sufficient to raise the pH to 3.5), and sodium chloride (60.00 g). Shortly before processing, hydrogen peroxide (100 mL of a 30% by weight aqueous solution) was added along witch sufficient water to adjust the volume to 4.0 liters, and sufficient sodium carbonate to adjust the pH to 3.50.

EXAMPLE 2

Measurement of Bleaching Rates with a Flow-Cell Apparatus

Strips (35 mm×304.8 mm) of Kodacolor Gold 100 film were given a flash exposure on a 1B sensitometer (1/25 sec, 3000K. Daylight Va filter). The strips were developed and fixed (but not bleached) at 100° F. in standard color negative processing solutions, (see *British Journal of Photography*, p. 196, 1988), as shown below:

| | |
|---|---|
| 3'15" | Developer Bath |
| 1' | Stop Bath |
| 1' | Water Wash |
| 4' | Fixing Bath |
| 3' | Water Wash |
| 1' | Water Rinse |

The film strips were air dried. To measure a bleaching rate, a 1.3 $cm^2$ round punch was removed from the strip and placed in a flow cell. This cell, 1 cm ×1 cm×2 cm, was constructed to hold the film punch in a UV/visible diode array spectrophotometer, enabling the visible absorption of the punch to be measured while a processing solution is circulated past the face of the punch. Both the processing solution (20 ml) and the cell were thermostated at 25° C. One hundred absorbance measurements (an average of the absorptions at 814, 816, 818, and 820 nm) were collected, typically, at five-second intervals over a 500-second span. The absorbance as a function of time was plotted, and the time required for 50% bleaching was determined graphically. Control experiments indicate that this flow cell method is an excellent predictor of bleaching rates in a standard process run at 37.7° C. (100° F.).

The data in Table 1, below, summarize bleaching rates for ferric-catalyzed persulfate bleaches prepared with a variety of ligands. The fastest bleaching rates are obtained with ligands of 25, the present invention. All bleaches contain 12.5 mM ferric ion, 27.5 mM ligand, 125 mM persulfate ion, 150 mM chloride ion, and 1000 mM total acetate buffer at pH 4.0. The preparations of these bleaches were analogous to the preparation of Bleach A in Example 1. Structures of ligands are given following Table 1.

TABLE 1

Flow-Cell Bleaching Rates As A Function of Ligand

| Ligand | Time For 50% Bleaching(Sec) |
|---|---|
| L-1 (comparison) | (negligible bleaching after 3600 sec) |
| L-2 (comparison) | (negligible bleaching after 3600 sec) |
| L-3 (comparison) | 3000 |
| L-4 (comparison) | 2800 |
| L-5 (comparison) | 1400 |
| L-6 (invention) | 55 |
| L-7 (invention) | 440 |
| L-8 (invention) | 33 |
| L-9 (invention) | 270 |

TABLE 1-continued

Flow-Cell Bleaching Rates As A Function of Ligand

| | |
|---|---|
| L-10 (invention) | 430 |

Ligand Structures For Table 1.

L-1

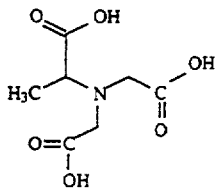

L-2

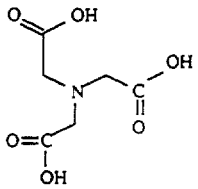

L-3

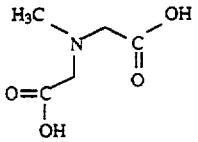

L-4

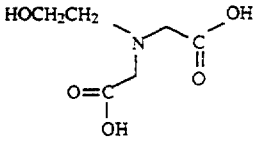

L-5

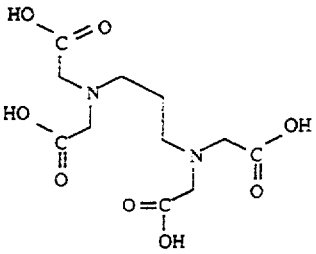

L-6

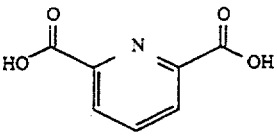

L-7

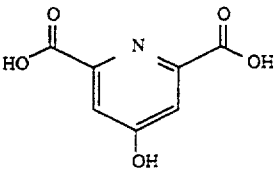

L-8

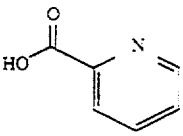

L-9

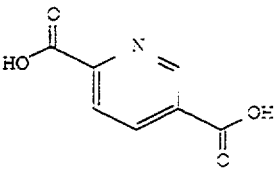

TABLE 1-continued

Flow-Cell Bleaching Rates As A Function of Ligand

L-10

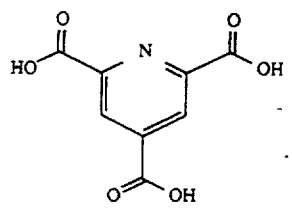

EXAMPLE 3

Measurement of Bleaching Rates in Sink-line Process

Strips (35 mm×304.8 mm) of Kodacolor Gold 100 film were given a stepwise exposure on a 1B sensitometer (½ sec, 3000K, Daylight Va filter, 21 step 0–6 chart; step 1 corresponds to maximum exposure and maximum density). The following process using standard color negative processing solutions, except for the bleaches, was run at 37.8° C. (see *British Journal of Photography*, p. 196, 1988):

| | |
|---|---|
| 3'15" | Developer Bath |
| 1' | Stop Bath |
| 1' | Water Wash |
| 0–3'* | Bleach A, B, Or C (With Continuous Air Agitation) |
| 3' | Water Wash |
| 4' | Fixing Bath |
| 3' | Water Wash |
| 1' | Water Rinse |

(*bleach times were 0, 0.5, 1.0, 1.5, 2.0, 2.5, 3.0 minutes)

Film strips were air dried, and residual silver was determined at step 1 (maximum density) by X-ray fluorescence spectroscopy. Data for residual silver as a function of time in each bleach is presented in Table 2. It is apparent that bleach A rapidly converts silver to silver chloride, and the final silver level of 1.9 mg/ft$^2$ is low enough to have a negligible effect on the color contrast. Bleach B, which differs from bleach A only in the ligand, is almost completely inactive for bleaching silver. Bleach C, despite having an iron concentration three times greater than that of bleach A, bleaches silver more slowly than A, and leaves a final level of silver sufficient to adversely affect the color rendition of the film.

TABLE 2

X-Ray Fluorescence Data For Residual Silver At Step 1

| Bleach Time (min) | Bleach A Resid. Ag (mg/ft$^2$) | Bleach B Resid. Ag (mg/ft$^2$) | Bleach C Resid. Ag (mg/ft$^2$) |
|---|---|---|---|
| 0.0 | 130 | 129 | 130 |
| 0.5 | 31.6 | 128 | 57.2 |
| 1.0 | 8.2 | 129 | 16.5 |
| 1.5 | 4.4 | 127 | — |
| 2.0 | 3.8 | 125 | 7.8 |
| 2.5 | 2.6 | 126 | 7.9 |
| 3.0 | 1.9 | 124 | 7.1 |

EXAMPLE 4

Bleaching Rate Data for Ammonium-Free Bleach Formulations

Bleaches D and E, with sodium counterion and 12.5 and 6.25 mM ferric ion as described above, were compared to Bleach F, corresponding to Kodak Flexicolor Bleach III, a commercially available bleach with ammonium counterion and 111/1 ferric ion. Strips (35 mm×304.8 mm) of Kodak Gold 100 film were given a stepwise exposure on a 1B sensitometer (½ sec, 3000K, Daylight Va filter, 21 step 0–6 chart; step 1 corresponds to maximum exposure and maximum density). The following process using standard color negative processing solutions, except for the bleaches, was run at 37.8° C. (see British Journal of Photography, p. 196, 1988):

| | |
|---|---|
| 3'15" | Developer Bath |
| 1' | Stop Bath |
| 1' | Water Wash |
| 0–3'* | Bleach D, E, Or F (With Continuous Air Agitation) |
| 3' | Water Wash |
| 4' | Fixing Bath |
| 3' | Water Wash |
| 1' | Water Rinse |

(*bleach times were 0, 20, 40, 60, 80, 100, 120, 180 seconds)

Film strips were air dried, and residual silver was determined at step 1 (maximum density) by X-ray fluorescence. Data for residual silver as a function of time in each bleach is presented in Table 3. As expected, bleach F rapidly bleaches silver in the maximum density region of the film. However, bleaches D and E, which contain, respectively, only 11.3 and 5.6% as much ferric ion and no ammonium ion, also bleach the film rapidly. This example also demonstrates the catalytic activity of the ferric complex of 2-pyridinecarboxylate (picolinate).

TABLE 3

X-Ray Fluorescence Data For Residual Silver At Step 1

| Bleach Time (sec) | Bleach D Resid. Ag (mg/ft$^2$) | Bleach E Resid. Ag (mg/ft$^2$) | Bleach F Resid. Ag (mg/ft$^2$) |
|---|---|---|---|
| 0 | 140.6 | 139.1 | 135.4 |
| 20 | 21.7 | 39.5 | 57.9 |
| 40 | 2.9 | 17.2 | 17.3 |
| 60 | 3.3 | 10.1 | 6.2 |
| 80 | 3.1 | 7.9 | 4.8 |
| 100 | 2.4 | 5.6 | 3.2 |
| 120 | 1.8 | 4.4 | 2.4 |
| 180 | 1.8 | 2.9 | 1.0 |

EXAMPLE 5

Incorporation of the Ferric Complex into a Photographic Element

This example illustrates that the ferric complex catalyst need not be present in the bleach itself but may be introduced via incorporation in the photographic element. It further illustrates that the ferric complex catalyst is beneficially used in conjunction with known aminoalkyl thiol bleach accelerators.

Multilayer, multicolor *Photographic Sample* 101 (PE101) was prepared by applying the following layers sequentially to a clear acetate support:

Layer 1 (antihalation layer): comprising red, green, blue, and UV-light absorbing permanent and soluble dyes, grey silver, and gelatin.

Layer 2 (low sensitivity red-sensitive layer): comprising red-sensitive silver halide emulsions, cyan dye-forming image couplers and gelatin.

Layer 3 (medium sensitivity red-sensitive layer): comprising red-sensitive silver halide emulsions, cyan dye-forming image couplers and gelatin.

Layer 4 (high sensitivity red-sensitive layer): comprising red-sensitive silver halide emulsions, cyan dye-forming image couplers and gelatin.

Layer 5 (interlayer): comprising gelatin.

Layer 6 (low sensitivity green-sensitive layer): comprising green-sensitive silver halide emulsions, magenta dye-forming image couplers and gelatin.

Layer 7 (medium sensitivity green-sensitive layer): comprising green-sensitive silver halide emulsions, magenta dye-forming couplers and gelatin.

Layer 8 (high sensitivity green-sensitive layer): comprising green-sensitive silver halide emulsions, magenta dye-forming image couplers and gelatin.

Layer 9 (yellow filter layer): comprising blue density yellow filter dye and gelatin.

Layer 10 (low sensitivity blue-sensitive layer): comprising blue-sensitive silver halide emulsions, yellow dye-forming image couplers and gelatin.

Layer 11 (high sensitivity blue-sensitive layer): comprising blue-sensitive silver halide emulsions, yellow dye-forming image couplers and gelatin.

Layer 12 (ultra-violet protective layer): comprising UV-light absorbing dyes, Lippmann emulsion and gelatin.

Layer 13 (overcoat): comprising matte beads, lubricants and gelatin.

The various layers of this sample further comprised development inhibitor releasing couplers, masking couplers, oxidized developer scavengers, soluble mercaptan releasing couplers, surfactants, sequestrants, anti-static agents, coating aids, soluble and fixed absorber dyes, stabilizers and such as are known in the art.

Photographic sample 101 comprised 4.38 g per $m^2$ of silver, as silver halide, and 19.95 g per $m^2$ gelatin. Both conventional and tabular-shaped grains were employed. The tabular-Shaped grains had aspect ratios ranging from about 5:1 to about 11:1. The silver bromoiodide grains comprised about 3 to 5 mol percent iodide.

Photographic Sample 102 (PE 102) was like Photographic Sample 101 except that 0.151 g per $m^2$ of iron pyridine dicarboxylic acid was added, as a water solution, to layer 1 during coating preparation.

Photographic Sample 103 (PE 103) was like Photographic Sample 101 except that 0.303 g per $m^2$ of iron pyridine dicarboxylic acid was added, as a water solution, to layer 1 during coating preparation.

The couplers used in Photographic Samples 101, 102, and 103 were couplers C-2, C-9, C-11, C-13, C-15, C-25, C-26, C-29, C-30, C-34, and C-35.

Film strips (35 mm×304.8 mm) were given a stepwise exposure on a 1B sensitometer (½ sec, 3000 K, Daylight Va filter, 21 Step 0–6 chart; step 1 corresponds to maximum exposure and maximum density). A process using standard color negative processing solutions (see *British Journal of Photography*, p. 196, 1988), except for a dimethylaminoethanethiol bleach accelerator and a persulfate bleach (see above for bleach and bleach pre-bath preparations) was run at 37.8° C:

| | |
|---|---|
| 3'15" | Developer Bath |
| 1' | Stop Bath |
| 1' | Water Wash |
| 1' | Bleach Pre-Bath G (With Continuous Nitrogen Agitation) |
| 0–4'* | Bleach H (With Continuous Air Agitation) |
| 3' | Water Wash |
| 4' | Fixing Bath |
| 3' | Water Wash |
| 1' | Water Rinse |

(*bleach times were 0, 15, 30, 60, 120, 240 seconds)

Film strips were air dried, and residual silver was determined at steps 1, 2, 3, (maximum density) by X-ray fluorescence spectroscopy. Data for residual silver at zero and 30 seconds bleaching is presented in Table 4.

TABLE 4

X-Ray Fluorescence Data For Residual Silver Averaged Over Steps 1, 2, And 3

| Film | $NaFe(PDCA)_2$ Content | Residual Metallic Silver: Before Bleaching | Residual Metallic Silver: After 30 Sec Bleaching |
|---|---|---|---|
| PE101 (comparison) | 0 mg/$ft^2$ | 131.0 mg/$ft^2$ | 26.4 mg/$ft^2$ |
| PE102 (invention) | 14 | 129.5 | 22.4 |
| PE103 (invention) | 28 | 130.2 | 18.1 |

It is apparent that, in a persulfate bleach preceded by a thiol pre-bath known in the art, bleaching occurs more rapidly when the ferric complex catalyst is present in the photographic element.

EXAMPLE 6

Employment of Ferric Complex Catalyst in a Bleach Pre-Bath

This example shows that the ferric complex catalyst can accelerate bleaching when it is introduced via a bleach pre-bath. This data also shows that bleach acceleration comparable to that of a known thiol bleach accelerator can be obtained without the unpleasant odor associated with the thiol.

Strips (35 mm×304.8 mm) of Kodacolor Gold 100 and Gold 100 Plus films were given a stepwise exposure on a 1B sensitometer (½ sec, 3000K, Daylight Va filter, 21 step 0–6 chart; step 1 corresponds to maximum exposure and maximum density). Three processes were run at 37.8° C. using standard color negative processing solutions, (see *British Journal of Photography*, p. 196, 1988), differing only in the composition of the bleach pre-bath (see Example 1 for composition and preparation of pre-bath G and bleach H and bleach pre-bath I):

| | |
|---|---|
| 3'15" | Developer Bath |
| 1' | Stop Bath |
| 1' | Water Wash |
| 1' | Bleach Pre-Bath G |
| 0–4'* | Bleach H |
| 3' | Water Wash |
| 4' | Fixing Bath |
| 3' | Water Wash |
| 1' | Water Rinse |

(*bleach times were 0, 15, 30, 60, 120, 240 seconds)

Film strips were air dried, and residual silver was determined at steps 1, 2, 3 (maximum density) by X-ray fluorescence spectroscopy. Data for residual silver at zero and 30 seconds bleaching as a function of pre-bath and film is presented in Table 5.

TABLE 5

X-Ray Fluorescence Data For Residual Silver Averaged Over Steps 1, 2, And 3

| | KodaColor Gold 100 | | KodaColor Gold 100 Plus | |
|---|---|---|---|---|
| Pre-Bath | 0" In Bleach | 30" In Bleach | 0" In Bleach | 30"In Bleach |
| None (comp.) | 121.6 mg/ft$^2$ | 116.8 mg/ft$^2$ | 139.6 mg/ft$^2$ | 137.9 mg/ft$^2$ |
| G (comp.) | 122.9 | 49.9 | 139.5 | 46.2 |
| I (inv.) | 120.8 | 27.4 | 136.9 | 50.1 |

Lower values of residual silver after 30" in the bleach correspond to greater bleaching rates. It is apparent that bleaching is extremely slow in that absence of a bleach pre-bath. For the two films in this example, the ferric complex catalyst pre-bath (pre-bath I) is as good as or better than the thiol pre-bath (pre-bath G) with respect to accelerating the persulfate bleach, yet the ferric catalyst pre-bath does not have an offensive odor like that of the thiol pre-bath. It should be noted that the ferric catalyst pre-bath is itself a very poor bleach; a control experiment showed that less than 6 mg Ag/ft$^2$ is bleached in either film during the 60" pre-bath I.

EXAMPLE 7

Bleaching of a Silver Chloride Photographic Element

This example demonstrates that a bleach formulation of the invention rapidly bleaches a silver chloride-based color paper and results in minimal retention of iron (a stain) in the element.

Kodak Ektacolor Edge Paper contains about 70 mg silver per square foot, of which greater than 95 mole percent is silver chloride. Strips (35×304.8 mm) of Kodak Ektacolor Edge Paper were given a stepwise exposure and processed as follows at 95° C.:

| | |
|---|---|
| 45" | Developer Bath |
| 25" | Wash Bath |
| 0, 10, 30, 50, 70" | Bleach J, K, or L (With Continuous Agitation) Bath |
| 45" | Wash Bath |
| 45" | Fixing Bath |
| 90" | Wash Bath |

Bleach J is a comparison, representative of bleaches known and widely used in the art; bleach K is of the present invention; bleach L is a comparison representative of DE 3,919,550. Preparation of all the bleaches can be found in Example 1 above.

Measurements of silver by infrared density indicated that all three bleaches produced adequate bleaching after 50 seconds. Residual iron in the strips bleached for 90 seconds was determined by X-ray fluorescence spectroscopy. Values for retained iron as a function of bleach are given in Table 6 below:

TABLE 6

X-Ray Fluorescence Data For Retained Iron In Color Paper As A Function Of Bleach

| Bleach | Retained Iron (mg/sq. ft.) |
|---|---|
| (raw stock; unprocessed) | 0.24 |

TABLE 6-continued

X-Ray Fluorescence Data For Retained Iron In Color Paper As A Function Of Bleach

| Bleach | Retained Iron (mg/sq. ft.) |
|---|---|
| J | 0.33 |
| K | 0.31 |
| L | 0.46 |

These data show that bleach K of the invention provides rapid bleaching of a silver chloride-based color photographic paper and minimizes the stain associated with retained iron.

EXAMPLE 8

Bleaches With Aromatic Carboxylic Acid Buffers

Strips (35 mm×304.8 mm) of Kodacolor Gold Ultra 400 Film were given a flash exposure on a 1B sensitometer (½ sec, 3000K, Daylight Va filter, 21 step tablet, 0–6 density; step 1 corresponds to maximum exposure and maximum density). The following process using standard color negative processing solutions, except for the bleaches, was run at 37.8 C (See British Journal of Photography, p 196, 1988):

| | |
|---|---|
| 3'15" | Developer Bath |
| 1' | Stop Bath |
| 1' | Water Wash |
| 0–2'* | Bleach F, M, N, O (With Continuous Air Agitation |
| 3' | Water Wash |
| 4' | Fixing Bath |
| 3' | Water Wash |
| 1' | Water Rinse |

(*bleach times were 0, 15, 30, 60, 120 seconds)

The film strips were dried, and residual silver was determined by x-ray fluorescence spectroscopy at steps 1, 2, and 3. The residual silver levels at these three steps were averaged to give the "Dmax silver" values in Table 7. It is evident that good bleaching was achieved with the aromatic carboxylic acid buffered bleaches of the invention.

TABLE 7

Effect Of Buffer On Persulfate Bleaching Rates At pH 3.5

| BLEACH | Bleach Time (min) | Dmax silver (mg/sqft) |
|---|---|---|
| F (invention) | 0 | 148.700 |
| F | 15 | 85.500 |
| F | 30 | 54.833 |
| F | 60 | 16.633 |
| F | 120 | 4.800 |
| O (comparison) | 0 | 141.133 |
| O | 15 | 73.433 |
| O | 30 | 37.200 |
| O | 60 | 14.167 |
| O | 120 | 6.133 |
| M (comparison) | 0 | 150.133 |
| M | 15 | 69.567 |
| M | 30 | 34.033 |
| M | 60 | 11.833 |
| M | 120 | 6.433 |
| N (comparison) | 0 | 143.033 |
| N | 15 | 76.900 |
| N | 30 | 33.967 |
| N | 60 | 11.067 |
| N | 120 | 7.067 |

EXAMPLE 9

A silver halide color paper, containing 2-equivalent magenta coupler C-38, in the form of strips that were 305 mm long and 35 mm wide, was given a suitable exposure to light and then processed using Kodak's Process-RA solutions, as described in the British Journal of Photography, p. 191 (1988), except for the bleaches.

| Process Step | Process Time sec | Process Temp Deg F. |
|---|---|---|
| Color Development | 45 | 95 |
| Stop Bath | 30 | 95 |
| Water Wash | 30 | 95 |
| Bleach | 90 | 95 |
| Water Wash | 45 | 95 |
| Fixer | 45 | 95 |
| Water Wash | 90 | 95 |

The following bleach formulations were used:

| | Bleach P (Invention) | Bleach O (Invention) | Bleach R (Invention) | Bleach S (Comparison) |
|---|---|---|---|---|
| beta alanine | 5.6 mM | 5.6 mM | 5.6 mM | 5.6 mM |
| 2,6-pyridinedi-carboxylic acid | 4.0 mM | 4.0 mM | 4.0 mM | 0 |
| ethylenediaminetetra-acetic acid*$Na_4$ | 0 | 0 | 0 | 2.0 mM |
| Acetic Acid | 87 mM | 0 | 0 | 87 mM |
| 5-sulfoisophthalic acid mono sodium salt | 0 | 87 mM | 0 | 0 |
| potassium hydrogen phthalate | 0 | 0 | 87 mM | 0 |
| $Fe(NO_3)_3*_9H_2O$ | 1.8 mM | 1.8 mM | 1.8 mM | 1.8 mM |
| $Na_2S_2O_8$ | 51.0 mM | 51.0 mM | 51.0 mM | 51.0 mM |
| NaCl | 125 mM | 125 mM | 125 mM | 125 mM |
| pH | 3.5 | 3.5 | 3.5 | 3.5 |

The pH was adjusted with either 7N Sulfuric Acid or 10% Sodium Carbonate.

Residual silver was determined at step 1 (maximum density) by X-ray fluorescence spectroscopy. Data for residual silver in each bleach are presented in Table 8. It is apparent that Bleaches P, Q and R of the invention remove silver from the paper more rapidly than does Bleach S.

TABLE 8

X-Ray Fluorescence Data For Residual Silver at Step 1
Residual Silver ($mg/ft^2$)

| Bleach A | Bleach B | Bleach C | Bleach D |
|---|---|---|---|
| 0 | 1.53 | 1.1 | 50.05 |

EXAMPLE 10

Strips (35 mm×304.8 mm) of Kodacolor Gold Ultra 400 film were given a stepped exposure on a 1B sensitometer (1/100 sec, 3000K., Daylight Ca filter, 21 step tablet, 0–4 density; step 1 corresponds to maximum exposure and maximum density). The following process using standard color negative processing solutions, except for the bleaches, was run at 37.8 C. (see British Journal of Photography, p 196, 1988):

| | |
|---|---|
| 3'15" | Developer Bath |
| 1' | Stop Bath |
| 1' | Water Wash |
| 0–4'* | Bleach P (with continuous air agitation) |
| 3' | Water Wash |
| 4' | Fixing Bath |
| 3' | Water Wash |
| 1' | Water Rinse |

(*bleach times were 0, 15, 30, 45, 60, 75, 90, 120, 180, or 240 sec)

The film strips were dried, and residual silver was determined by x-ray fluorescence spectroscopy at steps 2, 3, and 4. The residual silver levels at these three steps were averaged to give the "Dmax Silver" values in Table 9. This example demonstrates the use of an effective and economical buffer, sulfosuccinic acid.

TABLE 9

A Ferric-Catalyzed Persulfate Bleach With Sulfosuccinic Acid Buffer

| bleach time (sec) | D-max Ag (mg/sq. ft.) |
|---|---|
| 0 | 106.700 |
| 15 | 48.133 |
| 30 | 25.833 |
| 45 | 11.867 |
| 60 | 9.400 |
| 75 | 5.633 |
| 90 | 5.967 |
| 120 | 5.267 |
| 180 | 5.533 |
| 240 | 4.967 |

EXAMPLE 11

Strips (35 mm×304.8 mm) of Kodacolor Gold Plus 100 film were given a stepped exposure on a 1B sensitometer (½ sec, 3000K., Daylight Va filter, 21 step tablet, 0–4 density; step 1 corresponds to maximum exposure and maximum density). The following process using standard color negative processing solutions, except for the bleaches, was run at 37.8 C. (see British Journal of Photography, p 196, 1988):

| | |
|---|---|
| 3'15" | Developer Bath |
| 1' | Stop Bath |
| 1' | Water Wash |
| 0–4'* | Bleach Q (with continuous air agitation) |
| 3' | Water Wash |
| 4' | Fixing Bath |
| 3' | Water Wash |
| 1' | Water Rinse |

(*bleach times were 0, 30, 60, 90, 120, 180, or 240 sec)

The film strips were dried, and residual silver was determined by x-ray fluorescence spectroscopy at steps 2, 3, and 4. The residual silver levels at these three steps were averaged to give the "Dmax Silver" values in Table 10. This example demonstrates excellent silver bleaching in a ferric-catalyzed, chloride-rehalogenating bleach using hydrogen peroxide instead of persulfate.

TABLE 10

| A Ferric-Catalyzed Hydrogen Peroxide Bleach | |
|---|---|
| bleach time (sec). | D-max Ag (mg/sq. ft.) |
| 0 | 109.467 |
| 30 | 35.567 |
| 60 | 7.667 |
| 90 | 3.533 |
| 120 | 2.300 |
| 180 | 2.300 |
| 240 | 1.067 |

The invention has been described in detail with particular reference to preferred embodiments thereof, but it will be understood that variations and modifications can be effected within the spirit and scope of the invention.

What is claimed is:

1. A bleaching composition for color silver halide photographic elements, said bleaching composition comprising a peracid or peracid bleaching agent salt and an accelerating amount of a complex of ferric ion and a 2-pyridinecarboxylic acid or a 2,6-pyridinedicarboxylic acid.

2. The composition of claim 1 wherein the peracid salt is a persulfate salt.

3. The composition of claim 1 wherein the peracid is hydrogen peroxide or a hydrogen peroxide precursor.

4. The composition of claim 1 wherein the 2-pyridinecarboxylic acid or 2,6-pyridinedicarboxylic acid is of the formula:

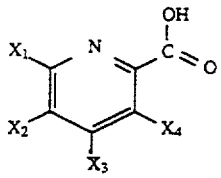

I

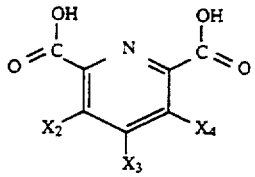

II wherein $X_1$, $X_2$, $X_3$ and $X_4$ are independently H, OH, $CO_2M$, $SO_3M$, or $PO_3M$, and M is H or an alkali metal cation.

5. The composition of claim 4 wherein $X_1$, $X_2$, $X_3$ and $X_4$ are H.

6. The composition of claim 1 wherein the concentration of the ferric ion is 0.001 to 0.100M and the concentration of the 2-pyridinecarboxylic acid or 2,6-pyridinedicarboxylic acid is 0.001 to 0.500M.

7. The composition of claim 6 wherein the concentration of the ferric ion is 0.001 to 0.025M and the concentration of the 2-pyridinecarboxylic acid or 2,6-pyridinedicarboxylic acid is 0.001 to 0.100M.

8. The composition of claim 1 wherein the pH of the composition is 3 to 6.

9. The composition of claim 2 wherein the concentration of the persulfate salt is 0.05 to 0.500M.

10. The composition of claim 3 wherein the concentration of the hydrogen peroxide or the hydrogen peroxide precursor is 0.10 to 2.0M.

11. The composition of claim 1 further comprising halide ion at a concentration of 0.025 to 2.0M.

12. The composition of claim 11 wherein the halide is chloride.

13. The composition of claim 11 wherein the concentration of halide ion is 0.050 to 0.500M.

14. The composition of claim 8 wherein the the bleach solution further comprises an aliphatic carboxylic acid buffer, an aromatic carboxylic acid buffer, a sulfo-substituted aliphatic carboxylic acid buffer or a sulfo-substituted aromatic carboxylic acid buffer such that the basic form of the buffer is less than 0.5M.

15. The composition of claim 1 wherein the composition comprises:

sodium persulfate at a concentration of 0.050 to 0.500M;

halide ion at a concentration of 0.025 to 2.00M;

and a complex of ferric ion at a concentration of 0.001 to 0.100M and a 2-pyridinecarboxylic acid or 2,6-pyridinedicarboxylic acid at a concentration of 0.001 to 0.500M;

the bleaching composition having a pH of 3 to 6.

16. The composition of claim 15 wherein the 2-pyridinecarboxylic acid or 2,6-pyridinedicarboxylic acid is of the formula:

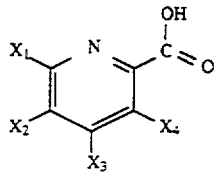

I

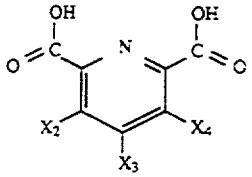

II wherein $X_1$, $X_2$, $X_3$ and $X_4$ are independently H, OH, $CO_2M$, $SO_3M$, or $PO_3M$, and M is H or an alkali metal cation.

17. The composition of claim 1 wherein the composition comprises:

hydrogen peroxide at a concentration of 0.10 to 2.0M;

halide ion at a concentration of 0.025 to 2.00M;

and a complex of ferric ion at a concentration of 0.001 to 0.100M and a 2-pyridinecarboxylic acid or 2,6-pyridinedicarboxylic acid at a concentration of 0.001 to 0.500M;

the bleaching composition having a pH of 3 to 6.

18. The composition of claim 17 wherein the 2-pyridinecarboxylic acid or 2,6-pyridinedicarboxylic acid is of the formula:

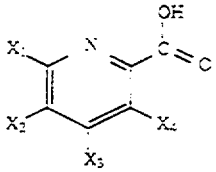

-continued

II

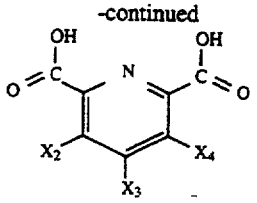

wherein $X_1$, $X_2$, $X_3$ and $X_4$ are independently H, OH, $CO_2M$, $SO_3M$, or $PO_3M$, and M is H or an alkali metal cation.

19. The composition of claim 1 wherein the composition comprises:

sodium persulfate at a concentration of 0.050 to 0.500M;

chloride ion at a concentration of 0,050 to 0,500M;

and a complex of ferric ion at a concentration of 0.001 to 0.025M and an unsubstituted 2-pyridinecarboxylic acid or 2,6-pyridinedicarboxylic acid at a concentration of 0.001 to 0.100M;

the bleaching composition having a pH of 3 to 6.

20. The composition of claim 1 wherein the composition comprises:

hydrogen peroxide at a concentration of 0.10 to 2.0M;

chloride ion at a concentration of 0.050 to 0.500 M;

and a complex of ferric ion at a concentration of 0.001 to 0.025M and an unsubstituted 2-pyridinecarboxylic acid or 2,6-pyridinedicarboxylic acid at a concentration of 0.001 to 0.100M;

the bleaching composition having a pH of 3 to 6.

21. A method of processing an imagewise exposed and developed color photographic element comprising contacting the photographic element with the bleaching composition of claim 1.

22. The method of claim 21 wherein the photographic element comprises a 2-equivalent magenta coupler.

23. The method of claim 21 wherein the bleach composition is a bleaching composition as claimed in any one of claims 2 through 20.

24. A method of processing an imagewise exposed and developed color photographic element comprising contacting the photographic element with a bleach prebath solution comprising a complex of ferric ion and a 2-pyridinecarboxylic acid or a 2,6-pyridinedicarboxylic acid, and subsequently contacting the photographic element with a peracid bleaching solution.

25. The method of claim 24 wherein the 2-pyridinecarboxylic acid or 2,6-pyridinedicarboxylic acid is of the formula:

I

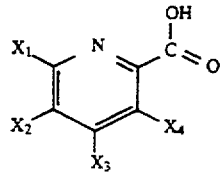

II

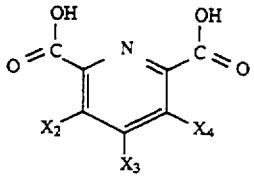

wherein $X_1$, $X_2$, $X_3$ and $X_4$ are independently H, OH, $CO_2M$, $SO_3M$, or $PO_3M$, and M is H or an alkali metal cation.

26. The method of claim 24 wherein the concentration of the ferric ion is 0.001 to 0.100M and the concentration of the 2-pyridinecarboxylic acid or 2,6-pyridinedicarboxylic acid is 0.001 to 0.500M.

27. The method of claim 22 wherein the 2-equivalent magenta coupler has the structure

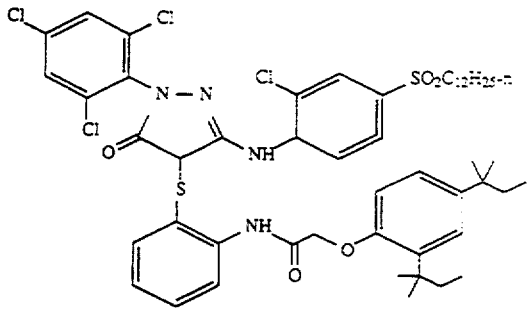

* * * * *